US009352176B2

(12) United States Patent
Erva et al.

(10) Patent No.: US 9,352,176 B2
(45) Date of Patent: May 31, 2016

(54) FIRE SUPPRESSION SYSTEM AND EMERGENCY ANNUNCIATION SYSTEM

(75) Inventors: Michael Walter Erva, Menominee, MI (US); Thomas Michael Halt, Calumet, MI (US); Donald Marvin Bjorkman, Menominee, MI (US); Brian Floyd Chernetski, Menominee, MI (US); Dorothy Ruohonen, Atlantic Mine, MI (US); Steven John Benda, Cokato, MN (US); Mark Neumann, Peshtigo, WI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 12/039,457

(22) Filed: Feb. 28, 2008

(65) Prior Publication Data

US 2008/0210443 A1 Sep. 4, 2008

Related U.S. Application Data

(60) Provisional application No. 60/904,551, filed on Mar. 2, 2007.

(51) Int. Cl.
*A62C 31/22* (2006.01)
*A62C 2/00* (2006.01)
(Continued)

(52) U.S. Cl.
CPC ..... *A62C 37/00* (2013.01); *G08B 25/12* (2013.01)

(58) Field of Classification Search
CPC ..... G08B 25/12; A62C 37/00
USPC ..... 169/70, 46, 56, 42, 65, 21, 23, 16, 37, 169/41, 51, 48, 57, 68, 43; 340/286.11; 239/209, 600; 242/398; 251/294; 137/797; 254/4 R, 4 B, 2 B, 134
See application file for complete search history.

(56) References Cited

U.S. PATENT DOCUMENTS 609,570 A 8/1898 Bowden
870,222 A 11/1907 Brydges
(Continued)

FOREIGN PATENT DOCUMENTS

CN 2565469 Y 8/2003
DE 20212878 U1 11/2002
(Continued)

OTHER PUBLICATIONS

Sava Industries, Inc., Push-Pull Control Assemblies [online], [retrieved from www.archiveorg from subdirectory dated 2005] [retrieved from http://www.savacable.com/catalog/p21-pushcontrols.htm].
(Continued)

*Primary Examiner* — Len Tran
*Assistant Examiner* — Steven M Cernoch
(74) *Attorney, Agent, or Firm* — Brinks Gilson & Lione

(57) ABSTRACT

A fire suppression and annunciation system using a flexible conduit and a wire rope is provided. The wire rope may be connected to a knob assembly at a universal pull station and to a release mechanism of the fire suppression system. An operator may pull a handle of the knob assembly at the universal pull station, thereby activating the release mechanism to release fire suppression agent. A flexible conduit may house the wire rope along at least a part of the connection from the universal pull station to the release mechanism. A material on the liner of the flexible conduit and/or on the wire rope may be used to reduce the coefficient of friction of wire rope in the flexible conduit. The fire suppression system may further include a pulley block system connected to the universal pull station. The pulley block system may comprise bearings, and may lower the force necessary to activate the release mechanism.

20 Claims, 44 Drawing Sheets

(51) Int. Cl.

| | |
|---|---|
| ***A62C 3/06*** | (2006.01) |
| ***A62C 3/00*** | (2006.01) |
| ***A62C 37/36*** | (2006.01) |
| ***A62C 35/60*** | (2006.01) |
| ***A62C 35/00*** | (2006.01) |
| ***A62C 25/00*** | (2006.01) |
| ***A62C 37/00*** | (2006.01) |
| ***G08B 25/12*** | (2006.01) |

(56) References Cited

U.S. PATENT DOCUMENTS

| | | | | | |
|---|---|---|---|---|---|
| 1,746,801 | A | * | 2/1930 | Sieben | 137/77 |
| 1,856,575 | A | | 5/1932 | Martin | |
| 1,974,844 | A | * | 9/1934 | Cartwright | 74/2 |
| 2,316,789 | A | | 4/1943 | Heigis | |
| 2,486,447 | A | | 11/1949 | Towart, Jr. | |
| 2,532,949 | A | | 12/1950 | Savage | |
| 2,630,018 | A | * | 3/1953 | Hannant | 74/107 |
| 2,726,381 | A | * | 12/1955 | Verkuil | 340/308 |
| 2,746,715 | A | * | 5/1956 | Sherrod | 254/134.3 R |
| 3,183,501 | A | | 5/1965 | Seaton | |
| 3,195,648 | A | | 7/1965 | Atack | |
| 3,299,901 | A | * | 1/1967 | Axe et al. | 134/123 |
| 3,419,083 | A | | 12/1968 | Cholin et al. | |
| 3,448,808 | A | | 6/1969 | Scofield et al. | |
| 3,464,433 | A | | 9/1969 | Michaelsen | |
| 3,515,218 | A | | 6/1970 | Gardner et al. | |
| 3,613,793 | A | | 10/1971 | Huthsing, Jr. | |
| 3,929,032 | A | * | 12/1975 | Kehm | 74/501.6 |
| 3,990,321 | A | | 11/1976 | Hurlow | |
| 4,066,147 | A | | 1/1978 | Toyomoto | |
| 4,112,708 | A | * | 9/1978 | Fukuda | 464/7 |
| 4,238,971 | A | | 12/1980 | Amelio | |
| 4,280,120 | A | | 7/1981 | Trafford | |
| 4,313,501 | A | | 2/1982 | Eckert | |
| 4,524,835 | A | | 6/1985 | Mingrone | |
| 4,541,615 | A | * | 9/1985 | King, Jr. | 254/134.3 FT |
| 4,580,638 | A | | 4/1986 | Jones et al. | |
| 4,854,388 | A | | 8/1989 | Wyatt | |
| 4,909,481 | A | * | 3/1990 | Tamm | 254/134.3 R |
| 4,946,137 | A | * | 8/1990 | Adamczek | 254/134.3 FT |
| 5,127,479 | A | * | 7/1992 | Stehling et al. | 169/65 |
| 5,236,177 | A | * | 8/1993 | Tamm | 254/134.3 FT |
| 5,241,880 | A | | 9/1993 | Mizobata et al. | |
| 5,297,636 | A | * | 3/1994 | North | 169/65 |
| 5,645,129 | A | * | 7/1997 | Renna | 169/51 |
| 5,868,477 | A | * | 2/1999 | Decarie | 312/245 |
| 5,871,056 | A | * | 2/1999 | Renna | 169/43 |
| 5,935,707 | A | | 8/1999 | Heuser | |
| 6,158,476 | A | * | 12/2000 | Sjotun | 138/126 |
| 6,173,791 | B1 | | 1/2001 | Yen | |
| 6,276,120 | B1 | * | 8/2001 | Adriaensen et al. | 57/210 |
| 6,286,604 | B1 | * | 9/2001 | Ou | 169/56 |
| 6,338,287 | B1 | * | 1/2002 | Uneme et al. | 74/502.5 |
| 7,323,637 | B2 | * | 1/2008 | Tideback | 174/50 |
| 2003/0146054 | A1 | * | 8/2003 | Kuo | 184/15.1 |
| 2007/0246234 | A1 | | 10/2007 | Vegso | |

FOREIGN PATENT DOCUMENTS

| | | | |
|---|---|---|---|
| EP | 0 077 602 | | 4/1983 |
| EP | 0902200 | A2 | 3/1999 |
| GB | 370057 | | 4/1932 |
| GB | 396524 | | 8/1933 |
| GB | 447621 | A | 5/1936 |
| GB | 2235379 | A | 3/1991 |
| JP | 11093511 | A | 4/1999 |
| JP | 2008-234307 | | 10/2008 |
| WO | WO00/09895 | | 2/2000 |

OTHER PUBLICATIONS

PCT International Search Report (the European Patent Office) regarding Application No. PCT/US2008/055307, dated Oct. 7, 2008, 5 pages.

PCT International Written Opinion (the European Patent Office) regarding Application No. PCT/US2008/055307, dated Oct. 15, 2008, 11 pages.

PCT International Search Report (the European Patent Office) regarding Application No. PCT/US2008/055307, dated Jun. 30, 2008, 6 pages.

PCT International Preliminary Report on Patentability for Application No. PCT/US2008/055307, dated Sep. 17, 2009, 13 pages.

European Search Report dated Jun. 15, 2010 for corresponding EP Appln. No. 10 16 2341 (7 pgs).

Search Report issued in EP Appl. No. 10 162 341.1 dated Jun. 15, 2010, 5 pages.

Office Action from corresponding Chinese Appln. No. 200880013410.2 dated Aug. 2, 2011 (7 pgs).

Examination Report issued in New Zealand Appl. No. 579394 dated Feb. 23, 2011, 2 pages.

Office Action from corresponding Israeli Appln. No. 200635 dated Feb. 28, 2012 (3 pages).

Office Action issued in corresponding EP Appln. No. 10162341.1 dated May 6, 2012 (4 pgs).

Office Action issued in corresponding Ukrainian Appln. No. 200909080 dated Apr. 28, 2012 (5 pgs).

Office Action issued in corresponding Chinese Appln. No. 201010231500.8 dated Apr. 28, 2012 (11 pgs).

Office Action issued in corresponding Ukraine Appln. No. 200909080 dated Nov. 23, 2012 (11 pgs).

Translation of a portion of the Office Action issued in corresponding Colombian Appln. No. 09-093287 dated Sep. 11, 2012 (6 pgs).

Office Action issued in corresponding Japanese Appln. No. 2009-552804 dated Jun. 22, 2012 (4 pgs).

Office Action issued in corresponding Australian Appln. No. 2008223154 dated Aug. 21, 2012 (4 pgs).

Office Action issued in corresponding Taiwanese Appln. No. 097107010 dated Jun. 26, 2013 (27 pgs) (partial translation).

Office Action issued in corresponding Korean Application No. 10-2014-7013367 dated Sep. 18, 2014 (7 pgs).

Office Action from corresponding Korean Application No. 10-2009-7020616 dated Mar. 23, 2015 (3 pages).

Office Action from corresponding Korean Application No. 10-2014-7013367 dated Apr. 14, 2015 (3 pages).

* cited by examiner

DETAIL F

SECTION E-E

DETAIL H

SECTION G-G

FIRE SUPPRESSION SYSTEM AND EMERGENCY ANNUNCIATION SYSTEM

REFERENCE TO RELATED APPLICATION

This application claims the benefit of U.S. Provisional Application No. 60/904,551, filed Mar. 2, 2007, the entirety of which is hereby incorporated by reference.

BACKGROUND OF THE INVENTION

1. Technical Field

The present invention relates to a fire suppression system activated manually (such as by a pull knob or electronically) or activated automatically (such as by the detection links in the detection line).

2. Related Art

Fire suppression systems may be activated using a pull knob. The pull knob may be located in the path of egress or near an operator of a machine, such as an oven, popcorn machine, etc., and may be used to activate the fire suppression system. In the event of a fire, the operator may pull the pull knob, thereby activating a release mechanism of the fire suppression system.

The release mechanism may indirectly or directly cause the fire suppression agent to be dispensed, thereby reducing or eliminate the fire. For example, FIG. 1 illustrates a fire suppression system 100 that using a pull handle 116 to activate a release mechanism 160. Specifically, the wire rope 140 may be connected between pull handle 116 and an oval sleeve 170 of the cable lever 190 of release mechanism 160. The oval sleeve 170 may be used to make a loop in the rope so that the connection is between the pull handle 116 and cable lever 190 of the release mechanism 160. The pull handle 116 may be part of a pull station 110, that includes a faceplate 114 and pull knob body 118, and is located in an area remote from hot oil kitchen apparatuses, such as oil fryer ovens. The color of the faceplate 114 is a brushed stainless color in order to blend with the kitchen apparatuses, etc. In the event of a flash fire on the hot oil surface, the operator may pull the pull handle 116, thereby activating the release mechanism 160 located within the system pressurizing control cabinet 162. The release mechanism 160 thereafter indirectly causes release of the fire suppression agent by creating a pressure surge into a container of fire suppression agent, such as foam or flame retardant material, which in turn causes a release of the fire suppression agent onto the flaming oil through permanently placed spray nozzles, and thus reducing or extinguishing the fire. Alternatively, the release mechanism may directly cause release of the fire suppression agent, such as the pull handle 116 activating a triggering release mechanism coupled directly to a fire suppression agent container such as a water container or such as a $CO_2$ fire extinguisher. Upon activation, water may be dispensed. Or, the $CO_2$ fire extinguisher (or other extinguishing agent) may discharge $CO_2$ (or nitrogen cartridges) to cause the pressurization of the agent, thereby expelling the agent through a fixed piping system into the containment area to eliminate the fire supporting $O_2$ and thus minimizing or extinguishing the fire. Alternatively, $CO_2$ may be used as the extinguishing agent The pull handle in the fire suppression system is coupled to the release mechanism. One way to couple the pull handle 116 to the release mechanism 160 is by using a rigid conduit mechanical system, such as shown in FIG. 1. A wire rope 140 is routed from the system pressurizing control cabinet 162 to the pull station 110 through rigid electrical mechanical tubing (EMT) 130 and making 90 degree turns through pulley elbows 150. Further, the rigid EMT 130 is connected to a junction box 120 via a conduit-to-junction box coupling 131 to the pull station 110. However, using rigid EMT tubing 130 and 90 degree elbows 150 is very labor intensive, expensive and not preferable to some building wall geometries and accesses.

Another way to couple the pull handle to the release mechanism is to route the wire rope 140 through an outer diameter (OD) (such as a ¼" diameter) pre-shaped rigid conduit tubing. The pre-shaped rigid conduit tubing is commonly used in situations like the popcorn machine because designs and component dimensions are known and fixed. The pre-shaped rigid tubing may be constructed using aluminum or stainless steel for example, to ensure that in the event of a fire, the wire rope 140 routing conduit is non-flammable and will function as designed under high heat conditions. Because the pre-shaped rigid conduit tubing does not include pulley elbows 150, the wire rope 140 encounters high friction, making pulling of the pull handle difficult.

Still another way to couple the pull handle to the release mechanism is to route the wire rope along a predetermined path (length and direction) defined by specific pulley systems located at each change in wire rope direction. Disadvantages to this method include the excess cost associated with the pulley system along with the lack of controlled routing. A simple loss of wire rope tension might result in the wire rope "jumping its pulley" and thus a complete failure of the wire rope system.

Yet another way to couple the pull handle to the release mechanism is by using a pneumatic system. The pull handle may trigger a change is gas pressure, thereby activating the release mechanism. While the pneumatic system may be easier to configure than the systems using the electrical EMT tubing 130 and the 90 degree pulley elbows 150 shown in FIG. 1 or the pre-shaped rigid conduit tubing, it is typically less reliable. Therefore, what is needed is an easily configurable and reliable system for activating a release mechanism of a fire suppression using a pull handle.

As discussed above, the pull handle 116 is part of a pull station 110. An example of a pull station 110 is illustrated in FIGS. 2, 3 and 4A-C. Configuration of the pull station 110 may include installing a break rod 112, as shown in FIGS. 4A-C. The break rod 112 is slid through break rod end bushings 113 until a set-screw end bushing 119 is screwed into break rod end bushing 113. However, sliding the break rod 112 into the break rod end bushings 113 may prove difficult. Further, pulling the pull handle 116 from the pull knob bushing 125 after installation of the break rod 112 may also prove difficult. The pull station 110 is illustrated in cross-section with the pull handle 116 connected (FIG. 2) and disconnected (FIG. 3). Due to the design, excess force is required when pulling in direction 134 to overcome the friction forces resulting from cable friction at friction points such as 132 and 133 shown in FIGS. 2 and 3. What is therefore needed is a pull station that is easier to configure and to activate.

SUMMARY OF THE INVENTION

A fire suppression system and/or an emergency annunciation system using a flexible conduit and a wire rope is provided. The flexible conduit and wire rope may be used in a fire suppression system, an emergency annunciation system, or a combination of a fire suppression and emergency annunciation system. The wire rope may be connected to a lever or handle at a pull station and to a release mechanism of the fire suppression system. An operator may pull the lever at the pull station, thereby activating the release mechanism to release, either directly or indirectly, fire suppression agent. A flexible conduit may be used to house the wire rope along at least a part of the connection from the pull station to the release mechanism. The flexible conduit may be used to route the wire rope in non-standard configurations between the remote pull station and the release mechanism, such as a local system pressurizing control cabinet. Alternatively, the wire rope may be connected to a lever or handle at a pull station and to a switch for a fire annunciator system. The operator may pull the lever at the pull station, thereby controlling the switch for the annunciator system to visually or aurally indicate a chemical leak or the like (such as by activating strobes, horns, speakers, or the like with a predetermined output).

A material on the interior of the flexible conduit and/or on the wire rope may be used to reduce the coefficient of friction of wire rope in the flexible conduit. The material may comprise a liner of the flexible conduit whereby the wire rope is disposed to slide axially within the liner of the flexible conduit. The liner may be composed of a flexible material, such as plastic, with a low coefficient of friction. The material may also comprise a lubricant, such as a liquid lubricant. The lubricant may be applied to the interior of the flexible conduit, such as the interior of the liner, and/or applied to the wire rope. With the lower coefficient of friction, a lower level of force may be necessary to pull the lever at the pull station in order to activate the release mechanism of the fire suppression system.

The fire suppression system may include a pull station that is configured to allow for easier installation, such as break rod installation without the use of tools and break rod installation in wall areas where there is space limitations. One of, or both, of the faceplate and the pull knob assembly (which may include a pull knob and/pull handle) may be rotated, such as up to rotated 90 degrees (either clockwise or counterclockwise) or rotated greater than 90 degrees, to facilitation break rod installation. In particular, installation of the break rod may occur when the pull knob is inserted into the faceplate and rotated approximately 90 degrees clockwise from its normal position (with the faceplate stationary). Rotation of the pull knob/break rod assembly in a rotational direction 90 degrees counter clockwise back into its normal position may then cause the break rod ends to engage into and then become fully seated in the corresponding slots contained within each sidewall protective barrier. Further, the break rod installation may be accomplished without the use of tools.

The faceplate may contain one or more mounting screw bosses, each with integral containment boundary diaphragms to prevent grease, dirt or grime from entering behind the pull station. These screw bosses may be located to correspond with the associated screw bosses found on electrical junction boxes (such as shallow or deep electrical junction boxes). The containment boundary diaphragm holes aligned with the electrical junction box mounting screw bosses may be punched out to enable the faceplate to be screw mounted to the electrical junction box. Removal of the containment boundary diaphragms thus may enable an assembly screw to be inserted through the hole and momentarily captured in that hole to enable positioning of the faceplate over the electrical junction box without the screws falling from the holes. The faceplate may further include one or more indicia that is a color or texture that is different from another portion of the faceplate (such as a contrasting color indicia). For example, one or more of the words that are on the faceplate may be red, fluorescent, or glow in the dark in order to differentiate the words (and the faceplate) from the surroundings (such as an aluminum background).

The pull station faceplate may also include functional standing protective barriers that may protect the pull knob and pull handle from side impact and may provide a protective and functional means to capture the ends of the break rod when the pull knob is installed and ready to be activated. Further, the faceplate may include storage for maintenance components. The maintenance components may include maintenance parts such as spare break rods or copper compression fittings.

The faceplate of the pull station may be integrated with a pulley block system. The pulley block system may securely engage into and with corresponding features of the faceplate. For example, the pulley block system may be press fitted into the faceplate of the pull station. The combination may create an assembly that routes the wire rope in the direction of and on centerline to the flexible conduit or to rigid conduit as it enters the electrical junction box. The faceplate and pulley block each may contain multiple and corresponding interengaging features to enable numerous wire rope direction routing capabilities. Specifically, the pulley block and pulley may be configured in various ways to enable the faceplate/pulley block assembly to be used on multiple electrical junction box designs such as shallow or deep boxes without a need for other assembly components. The pulley block assembly may contain cable quick-connect capturing features to enable rapid flexible conduit installation/engagement into the pull station assembly. This flexible conduit installation may be performed rapidly without tools, thereby minimizing the manpower required to field install this system.

The pull knob assembly of the pull station may be coupled to the wire rope using one or more set screws that may be directed perpendicular to the wire rope axis or may be coupled with the wire rope using a compression fitting secured at one end, both while allowing at least part of the pull knob assembly (such as the pull handle) rotational freedom to enable break rod installation all while the pull knob assembly is fully inserted into the faceplate's corresponding center boss. The pull knob assembly of the pull station may further include a snap-fit uniform cap for ease of pull knob assembly installation and ease of providing market specific labeling or culture specific language alterations without excess cost. The cap system may be labeled or colored in any fashion specific to the end user needs, all while using the standardized pull knob assembly base element.

As discussed above, a wire rope may be used to connect the pull knob assembly to the release mechanism. An auto wire rope tensioning mechanism may be used to maintain tension on some or all excess wire rope after installation. The tensioning mechanism may also maintain the pull knob assembly to be seated flush to the faceplate while it is in a ready-to-activate stance. Slight tension on the excess wire rope may enable the installation personnel the ability to test pull the wire rope through the rigid or flexible conduit without activating the system pressurizing control mechanism (provided the cartridge is not installed). The wire rope testing methodology may provide a single person the ability to validate that the field run conduit system (either using a rigid or flexible conduit) allowing free, unobstructed, movement of the wire rope without activating the system. Further, the tension of the wire rope may be maintained with a predetermined amount of force, thereby standardizing the amount of force required to pull the pull knob assembly.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 6:
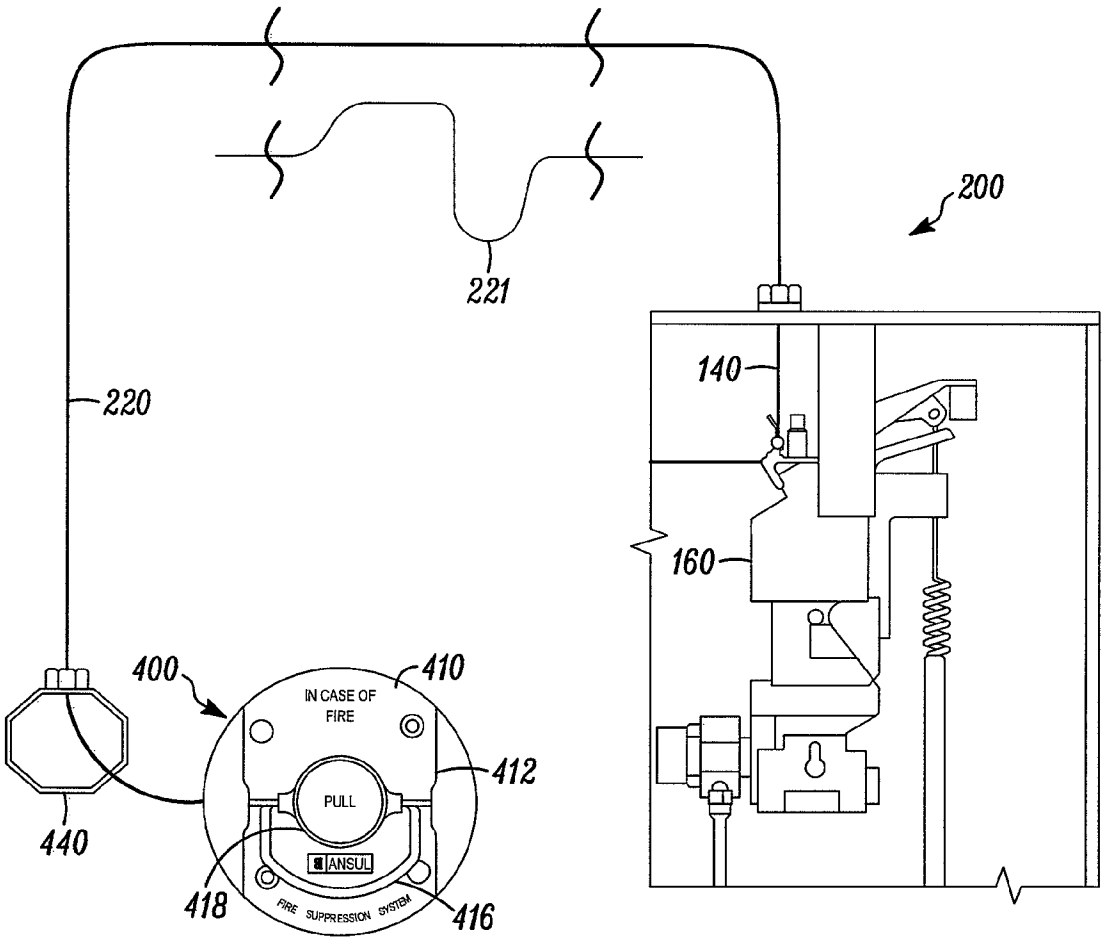
FIG. 6 is a representation of the pull station and flexible cable routing.
Figure 7A:
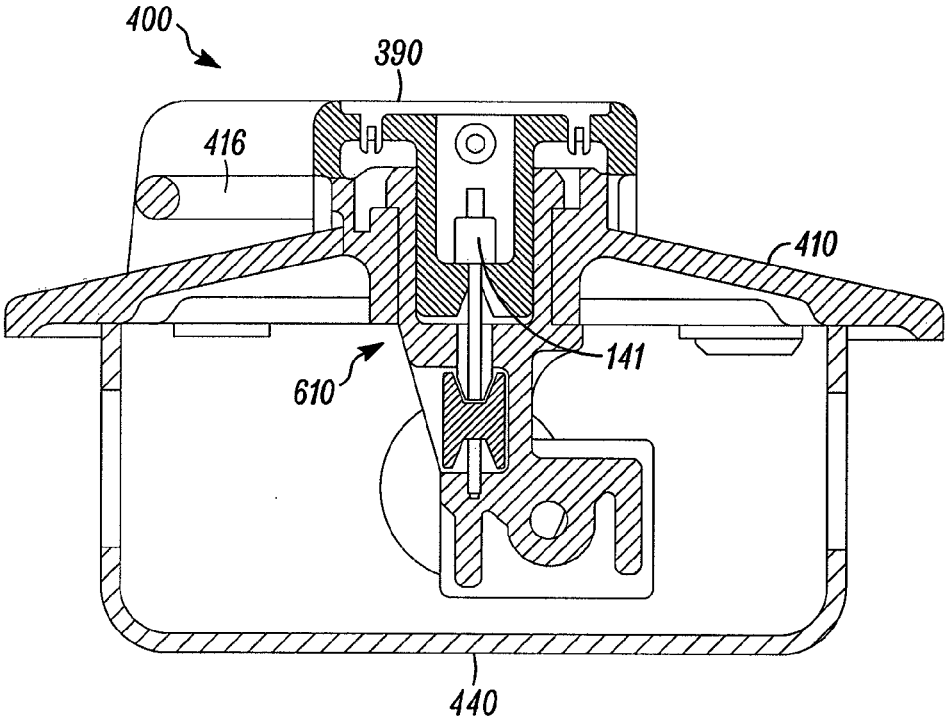
FIG. 7A is a first cross section of the pull station with integral pulley block and cable compression connection (such as a crimp stop) in a shallow junction box.
Figure 7B:
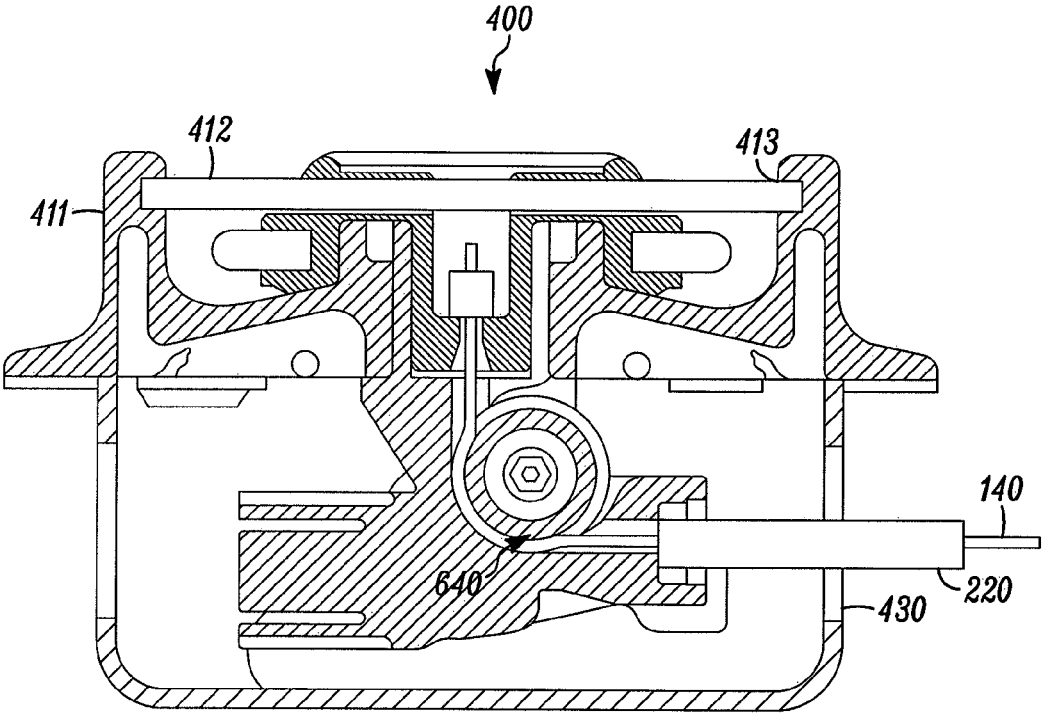
FIG. 7B is a second cross section of the pull station with integral pulley block and cable compression connection in a shallow junction box.
Figure 7C:
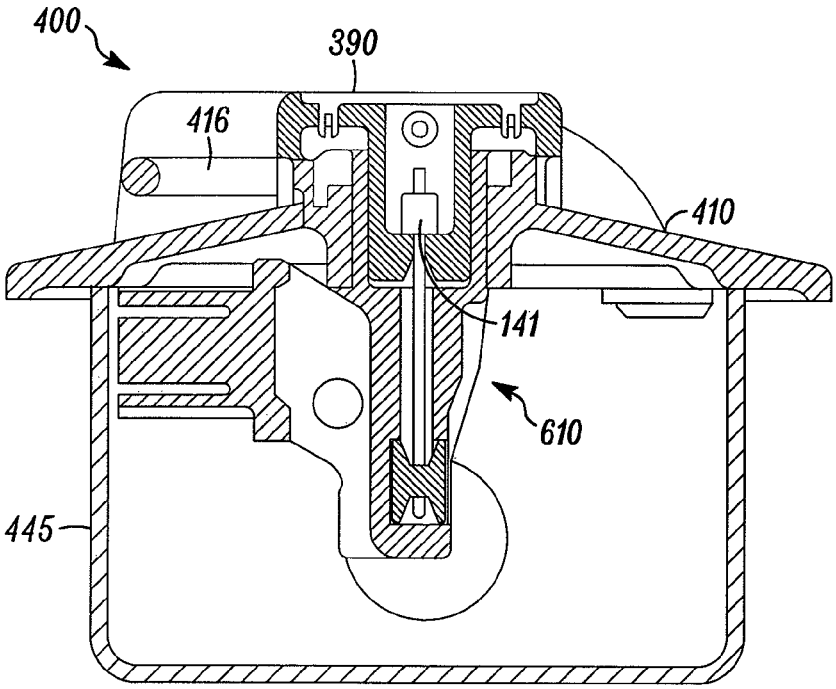
FIG. 7C is a first cross section of the pull station with integral pulley block and cable compression connection in a deep junction box.
Figure 7D:
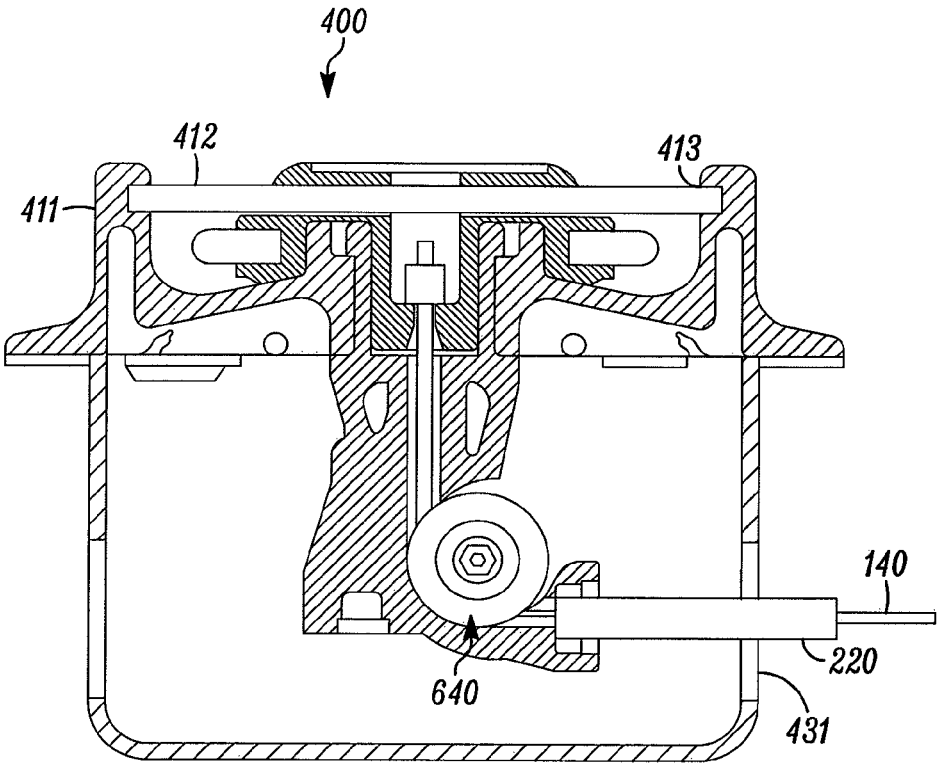
FIG. 7D is a second cross section of the pull station with integral pulley block and cable compression connection in a deep junction box.
Figure 8A:
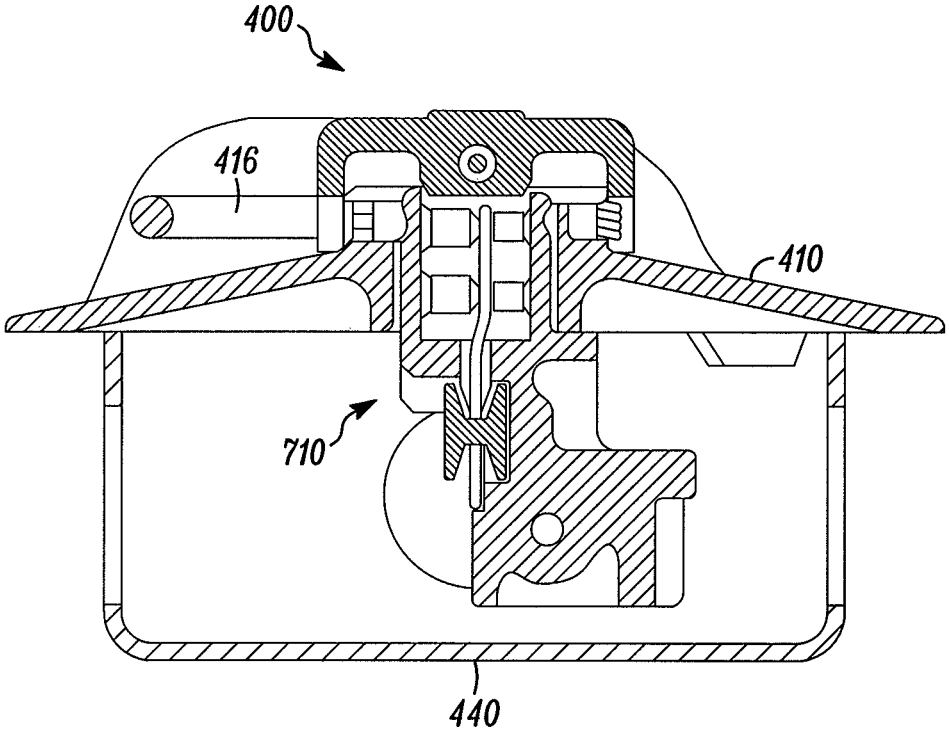
FIG. 8A is a first cross section of the pull station with integral pulley block and cable set screw connection in a shallow junction box.
Figure 8B:
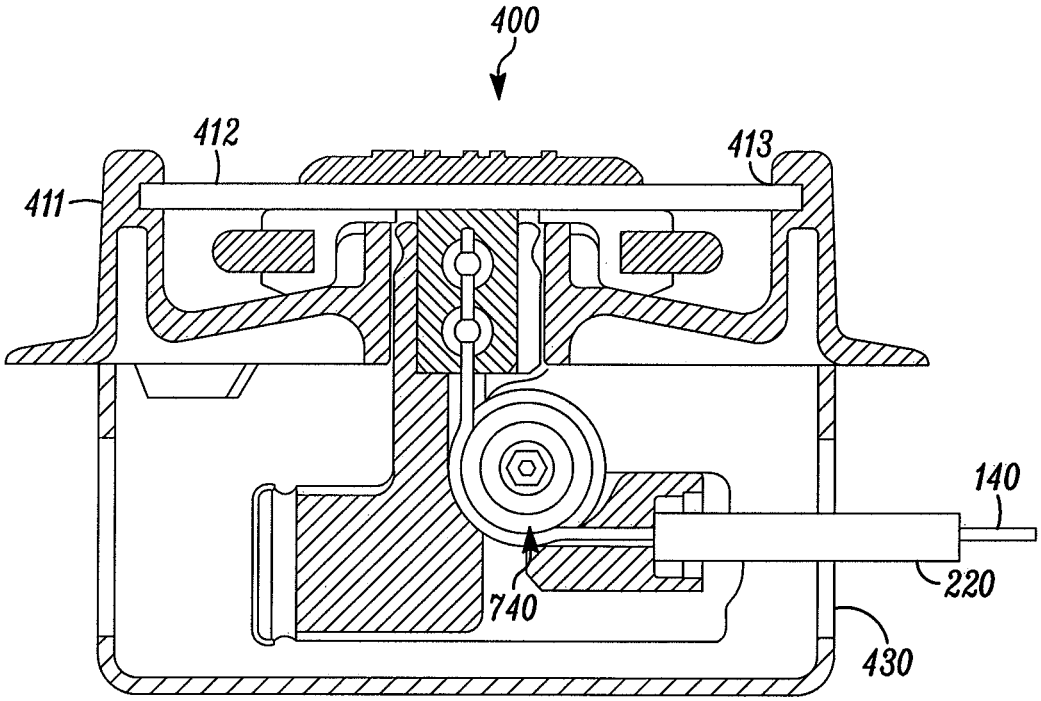
FIG. 8B is a second cross section of the pull station with integral pulley block and cable set screw connection in a shallow junction box.
Figure 8C:
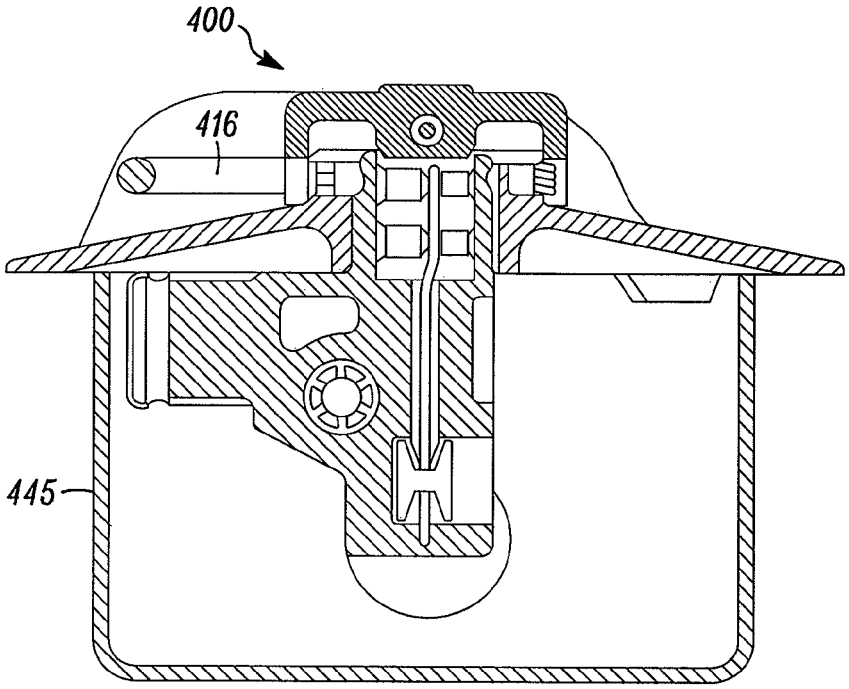
FIG. 8C is a first cross section of the pull station with integral pulley block and cable set screw connection in a deep junction box.
Figure 8D:
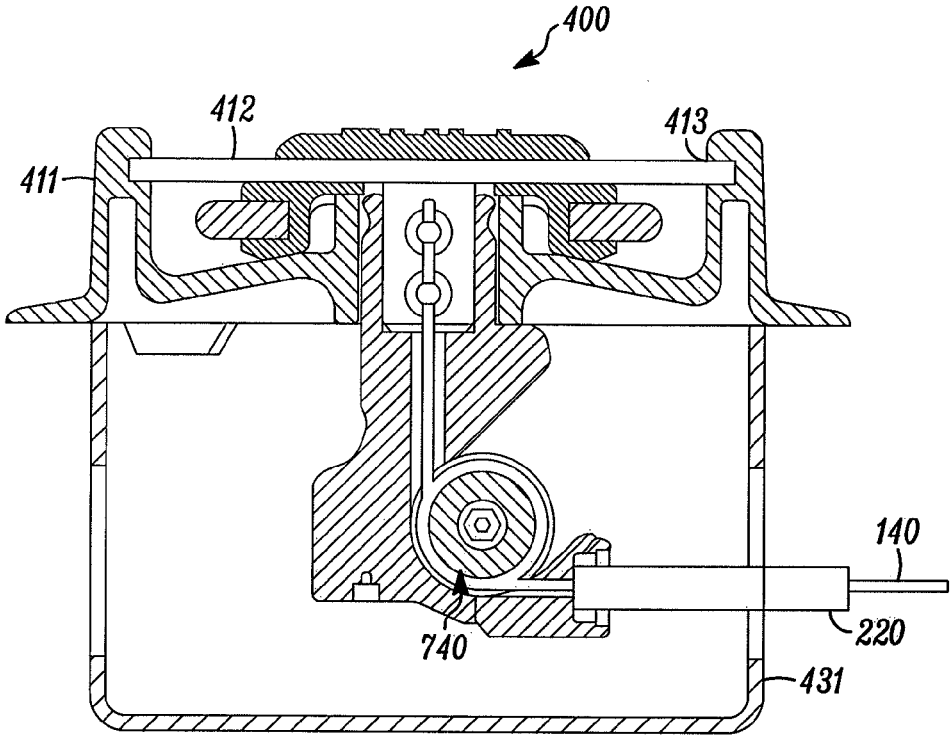
FIG. 8D is a second cross section of the pull station with integral pulley block and cable set screw connection in a deep junction box.

FIG. 6 is a block diagram illustrating a mechanical system for connecting the pull handle 416 of pull station 400 to the release mechanism 160 of the fire suppression system using a wire rope 140 contained within a flexible conduit 220. An example of the release mechanism 160 is a panel, such as the Ansul AUTOMAN® panel. Another example of the release mechanism 160 is a valve. Alternatively, flexible conduit 220 may be used to connect pull station 110 (shown in FIG. 1) with the release mechanism 160.

Figure 5A:
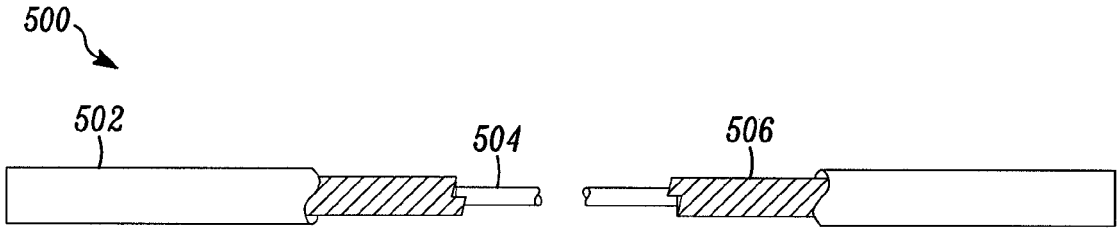
FIG. 5A illustrates a Bowden conduit.
Figure 5B:
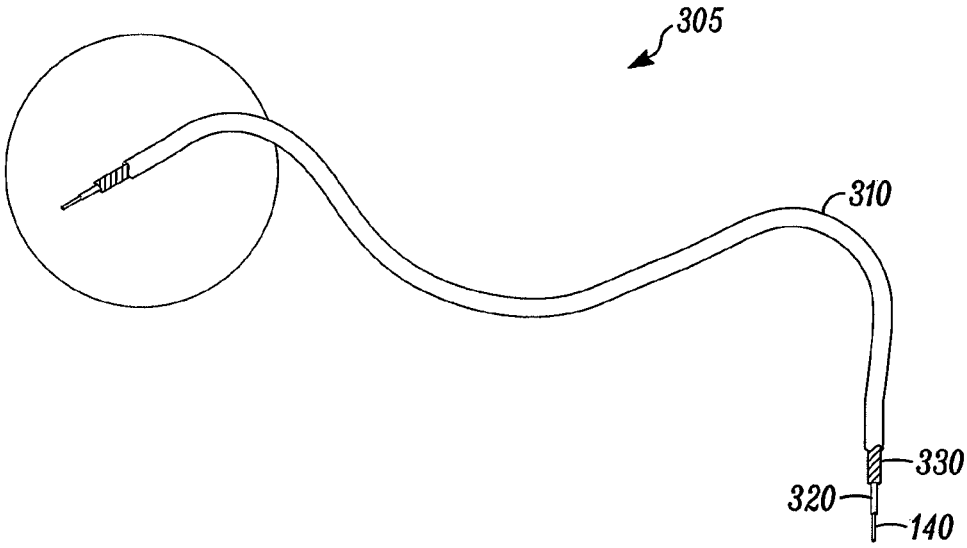
FIG. 5B illustrates a braided conduit with bends.
Figure 5C:
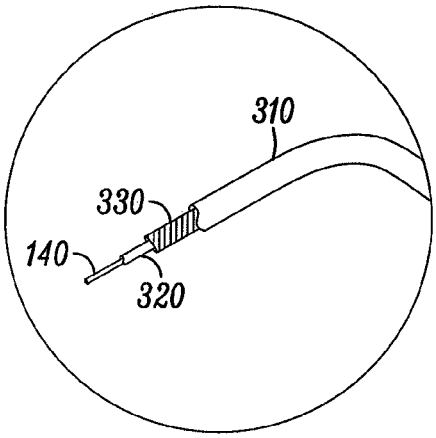
FIG. 5C illustrates a braided conduit with exploded construction view from FIG. 5B.

The flexible conduit 220 may be composed of a variety of types of conduits, such as a Bowden conduit and a braided conduit, as shown in more detail in FIGS. 5A-C. However, the flexible conduit is not limited to these types of conduits. The flexible conduit 220 may include a liner, a liner wrap, and an outer jacket. Though, the flexible conduit 220 does not need to include each of the liner, the liner wrap and the outer jacket. For example, the outer jacket need not be included in the flexible conduit. The flexible conduit 220 and wire rope 140 are coaxial mechanical devices whereby the wire rope 140 is disposed to slide axially within the liner of the flexible conduit 220. The flexible conduit 220 may be routed in non-standard configurations 221 as shown in FIG. 6. Further, the flexible conduit 220 may be used in combination EMT 130 and/or pulley elbows 150 to couple wire rope 140 between, for example, structures such as the pull station 400 and release mechanism 160. The wire rope 140 may be composed of a metal, such as an aircraft quality stainless steel braided wire rope with, for example, 7×7 braiding. The braiding of the wire rope may allow for the wire rope to be more bendable. Alternatively, the wire rope may have different braiding or no braiding at all.

The liner may comprise a material with a low coefficient of friction. For example, the liner may be composed of in part or whole a plastic material such as, for example, an acetal polymer, a polyethylene polymer, a PVC polymer, or a Teflon® fluoropolymer. In this manner, the liner may reduce the coefficient of friction between the liner and the wire rope whereby reducing the force required to slide the wire rope through the flexible conduit.

The liner wrap may comprise metal or composite, and may be a wire braid (such as a cross-weave), a flat wrap, or a wire wrap. The liner wrap may provide structural support to the flexible conduit 220, such as structural support to the liner. The liner wrap may be a mesh-type structure, with a plurality of holes there through. As discussed above, the flexible conduit may include an outer jacket. The outer jacket may comprise a polypropylene material, a PVC material, or other suitable plastics materials. The outer jacket, which may be free of holes, may be used for a variety of purposes. For example, the outer jacket may be used to form an impermeable and ductile outer sheathing for flexible conduit 220. The outer jacket may also be colored (such as red) thereby serving as a visual warning mechanism to identify this flexible conduit as "SAFETY RELATED". In addition to the red color, indicia (such as printed text) may be printed on the outer jacket. For example, black text may be printed against the red outer jacket indicating the "fire suppression cable—do not disturb".

One example of flexible conduit may include Bowden lined conduit 500, illustrated in FIG. 5A. The Bowden lined conduit 500 may include an outer jacket 502 composed of PVC. The outer jacket 502 may be a 0.197" outer diameter, for example. The Bowden lined conduit 500 may also include a wire wrap 506, acting as a liner wrap. And, the Bowden lined conduit 500 may include a polyethylene liner 504 acting as a liner. The wire rope 140 may be inside of the polyethylene liner 504. Another example of flexible conduit may include a braided conduit 305, illustrated in FIGS. 5B-5C. The braided conduit 305 may include a polypropylene outer jacket 310. The polypropylene outer jacket 310 may have a 0.203" outer diameter. The braided conduit 305 may include a wire braid 330, such as a 12-16 wire braid, acting as a liner wrap. And, the braided conduit 305 may include, an acetal liner 320 acting as a liner. Still another example of flexible conduit may include a long lay conduit with a polyethylene jacket of 0.187" outer diameter, a wire wrap, and a polyethylene liner. The flexible conduits illustrated in FIGS. 5A-5C may easily be bent without the need for permanent deformation (or reshaping) of the liner or liner wrap.

Further, a lubricant may be used to reduce the coefficient of friction between the wire rope 140 and the liner. In particular, a lubricant (such as a Silicone lubricant) may be added to one of, or both, the flexible conduit 220 and the wire rope 140. For example, the interior surface of the liner and/or the exterior surface of the wire rope 140 may be coated with a lubricant to reduce the coefficient of friction between the wire rope 140 and the liner. Alternatively, the liner may be attached to the wire rope 140. For example, the wire rope 140 may be coated with a lubricant that subsequently solidifies (or partly solidifies). In this way, the wire rope 140 and/or the flexible conduit 220 may include a liner. As discussed above, the flexible conduit 220 allows the wire rope 140 to be pulled at the pull station 400 in order to activate the release mechanism 160. The following is an equation of the forces associated with the pull station 400 and the release mechanism 160:

$$F1=F2\times e^{uskB}$$

where F1 is the force at the pull station 400;

F2 is the force at the release mechanism 160;

usk is the coefficient of friction; and

B is the radians of total flex where 360 degrees=2 pi radians for the flexible conduit 220 routing.

As discussed above, the liner of the flexible conduit 220 may be composed of a Teflon® fluoropolymer, which has a usk (coefficient of friction) of 0.040. According to the equation above, a flexible conduit 220 with no bends results in a force F1 at the pull station 400 of 1 pound to generate a 1 pound force at the release mechanism 160 (basically, no loss in the force generated from the pull station 400 to the release mechanism 160). Further, according to the equation shown above, a flexible conduit 220 with a summation of angular curves of 4.7 radians (270 degrees) requires a force F1 at the pull station 400 of 1.21 pounds to generate a 1 pound force at the release mechanism 160. In this way, even though the flexible conduit 220 has considerable bends in it, the amount of force necessary at the pull station 400 to generate a 1 pound force at the release mechanism 160 is substantially the same and not considerably higher than the flexible conduit 220 with no bends in it. Therefore, comparing the low friction flexible conduit to other conduits of higher friction, the flexible conduit 220 does not cause the operator of the pull station 400 to exert an inordinate amount of force to activate the release mechanism 160.

Figure 9A:
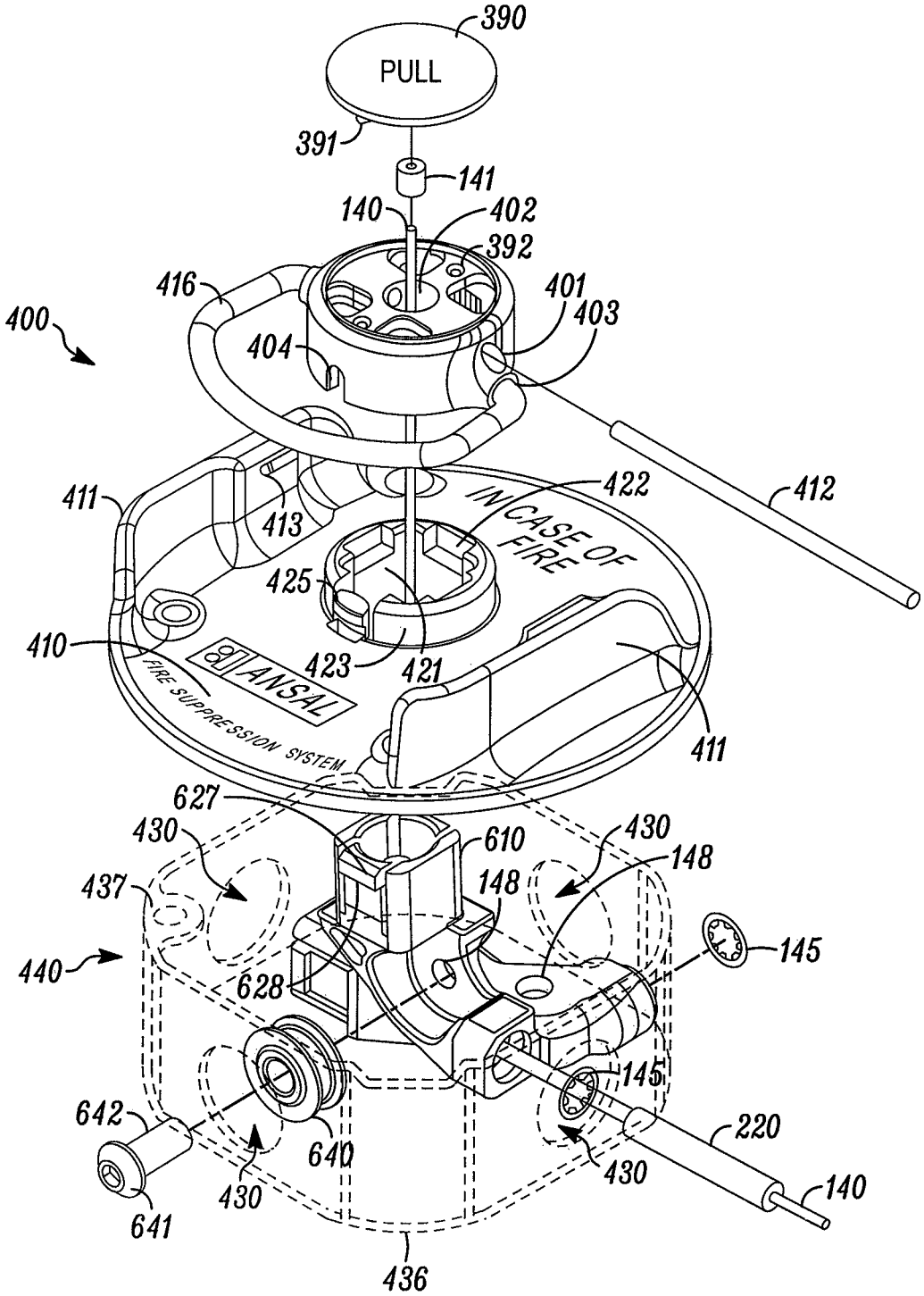
FIG. 9A is an exploded view of the pull station with pulley block snap-fit.
Figure 9B:
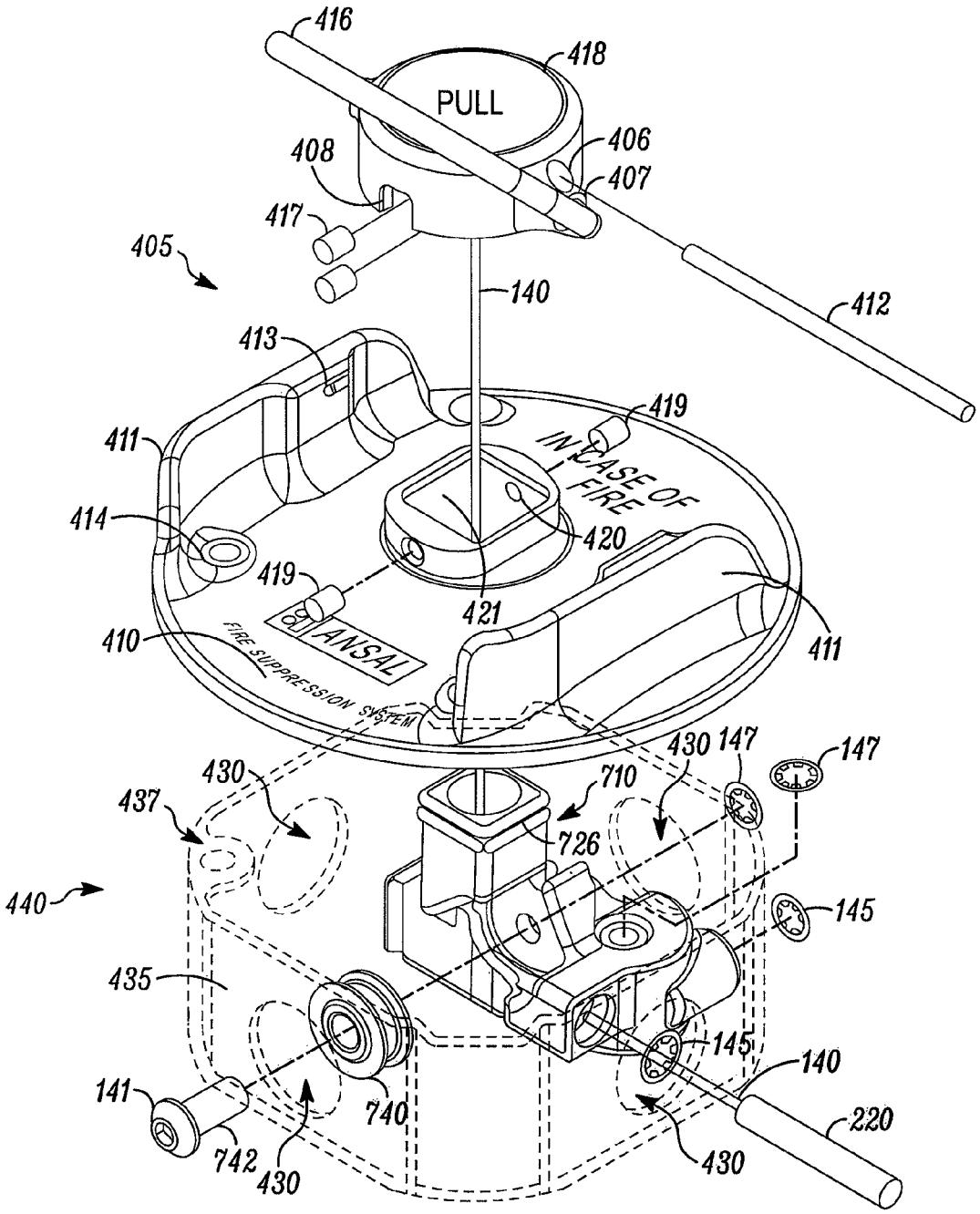
FIG. 9B is an exploded view of the pull station with pulley block set screw fit.

The fire suppression system may also include a pulley block 610 of FIG. 9A or 710 of FIG. 9B. Pulley blocks 610 and 710 may be installed proximate to the pull station 400 such as being connected to the pull station as shown in FIGS. 7A-D, 8A-D, 17A-B. Pulley blocks 610 and 710 may be connected to the pull station so that the wire rope 140 exits from the pulley block in any of multiple directions. For example, if the pull station 400 may be mounted flush to a wall, the wire rope 140 may exit from the pulley block 610 or 710 in any upward direction (toward the ceiling), a downward direction (toward the floor), to the right, and to the left.

The pulley blocks 610 and 710 may allow for installation in a variety of boxes, such as a standard electrical box 440, a deep electrical box 445, or no box. For a standard electrical box, the pulley blocks 610 and 710 may be configured in a first orientation (as shown in FIGS. 7A-B and 8A-B) for a shallow box. In a first configuration for a standard electrical junction box, portion 615 or 715 may be pressed into the faceplate 410 in receiving location 420 of the pull station (shown in FIGS. 9A-B and 16D). The portions 615 or 715 may be multi sided, such as square in shape, and may include a series of grooves 726 or snap fitting features 627 to provide positive engagement of the pulley blocks 610 and 710 into the faceplate 410. In this manner and with a square configuration, the pulley blocks 610 and 710 may be pushed into the faceplate 410 in any one of four positions, thus allowing the cable exit points to exit the junction boxes 440 and 445 in any one of four holes 430 or 431. In a second configuration for a deep electrical junction box, pulley box portions 620 or 720 may be pressed into the faceplate 410 of the pull station (shown in FIGS. 7C-D and 8C-D). The portions 620 or 720 may be multi sided, such as square in shape, and may include a series of grooves 726 or snap fitting features 627. In this manner and with a square configuration, pulley blocks 610 and 710 may be pushed into the faceplate 410 in any one of four positions, thus allowing the cable exit point of pulley blocks 610 and 710 to exit the junction box 440 and 445 in any one of four holes 430 or 431 respectively. The junction box 440 and 445 may include a box bottom 436 and a box screw boss 437. The junction box 440 may interface with EMT 130 using a conduit-to-junction box coupling 131 (as shown in FIG. 17A) or may interface with flexible conduit 220 using a strain relief (not shown in FIG. 17B).

Figure 17A:
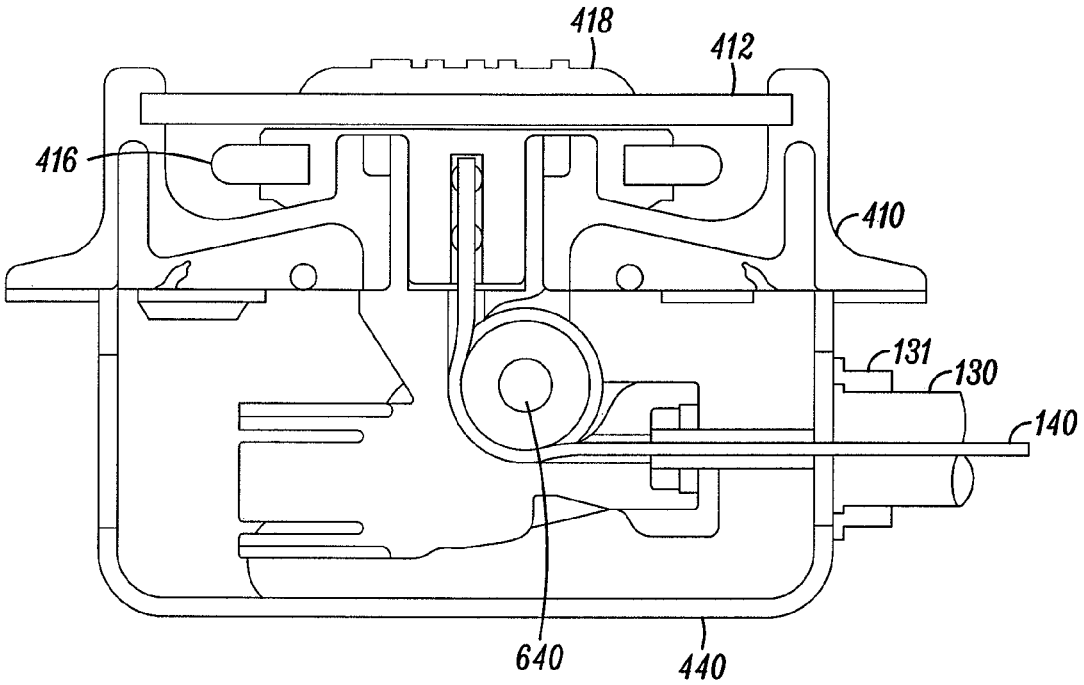
FIG. 17A is a side cross-section of the pull station with rigid conduit wire rope connection.
Figure 17B:
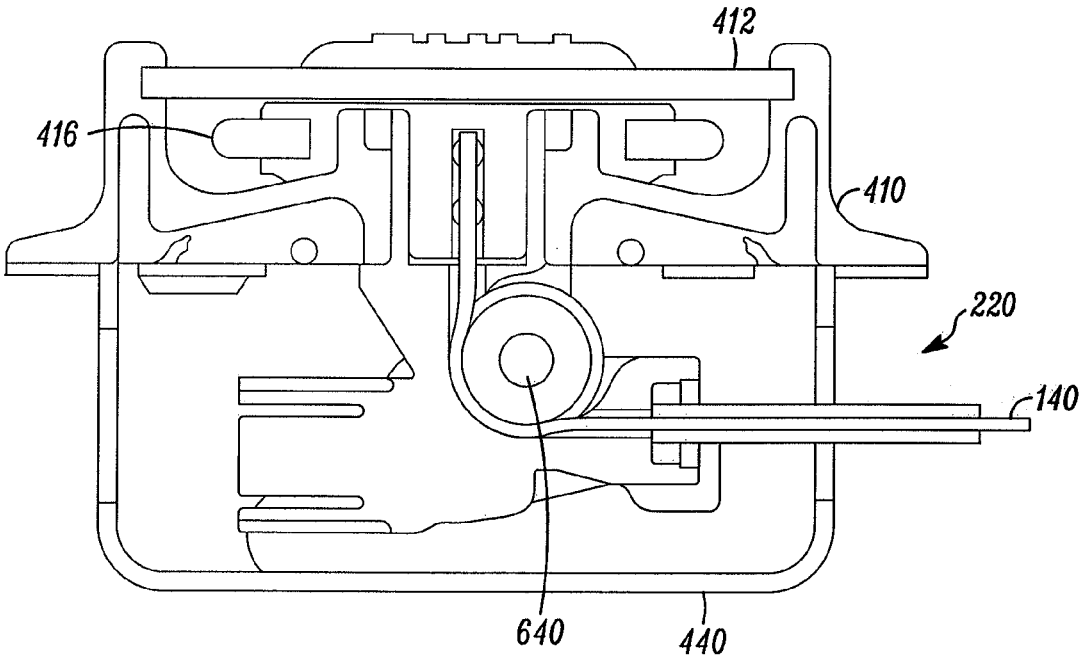
FIG. 17B is a side cross-section of the pull station with flexible conduit wire rope connection.
Figure 17D:
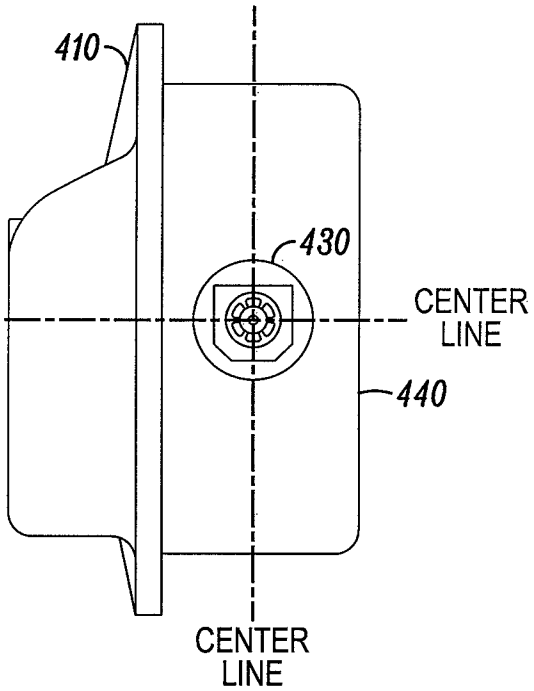
FIG. 17D is a side view of the pull station with wire rope routing on-center to the junction box interface hole.
Figure 17C:
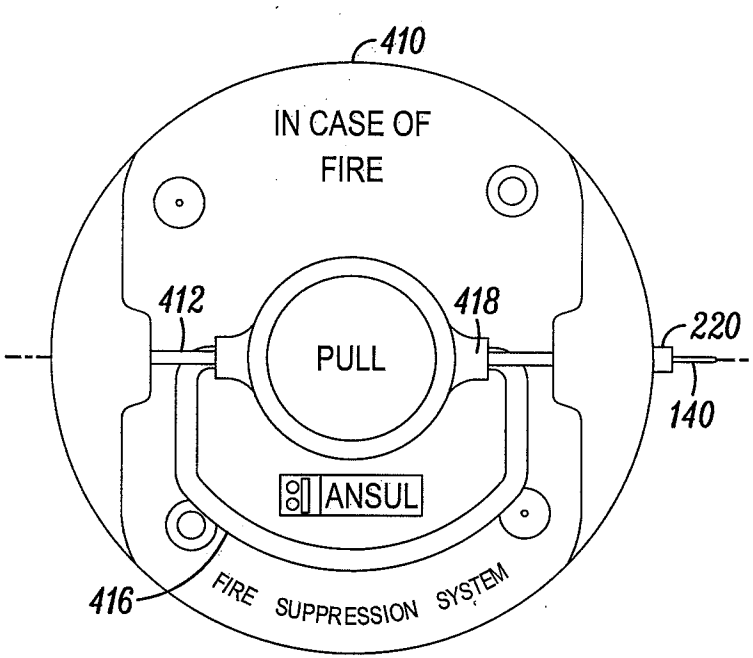
FIG. 17C is a front view of the pull station with wire rope routing on-center to the junction box interface hole.

The pulley blocks 610 and 710 are uniquely configured to ensure that field cable entering the shallow or deep electrical junction boxes may enter on centerline of the junction box access holes 430 or 431 as illustrated in FIGS. 17C-D.

Figure 10A:
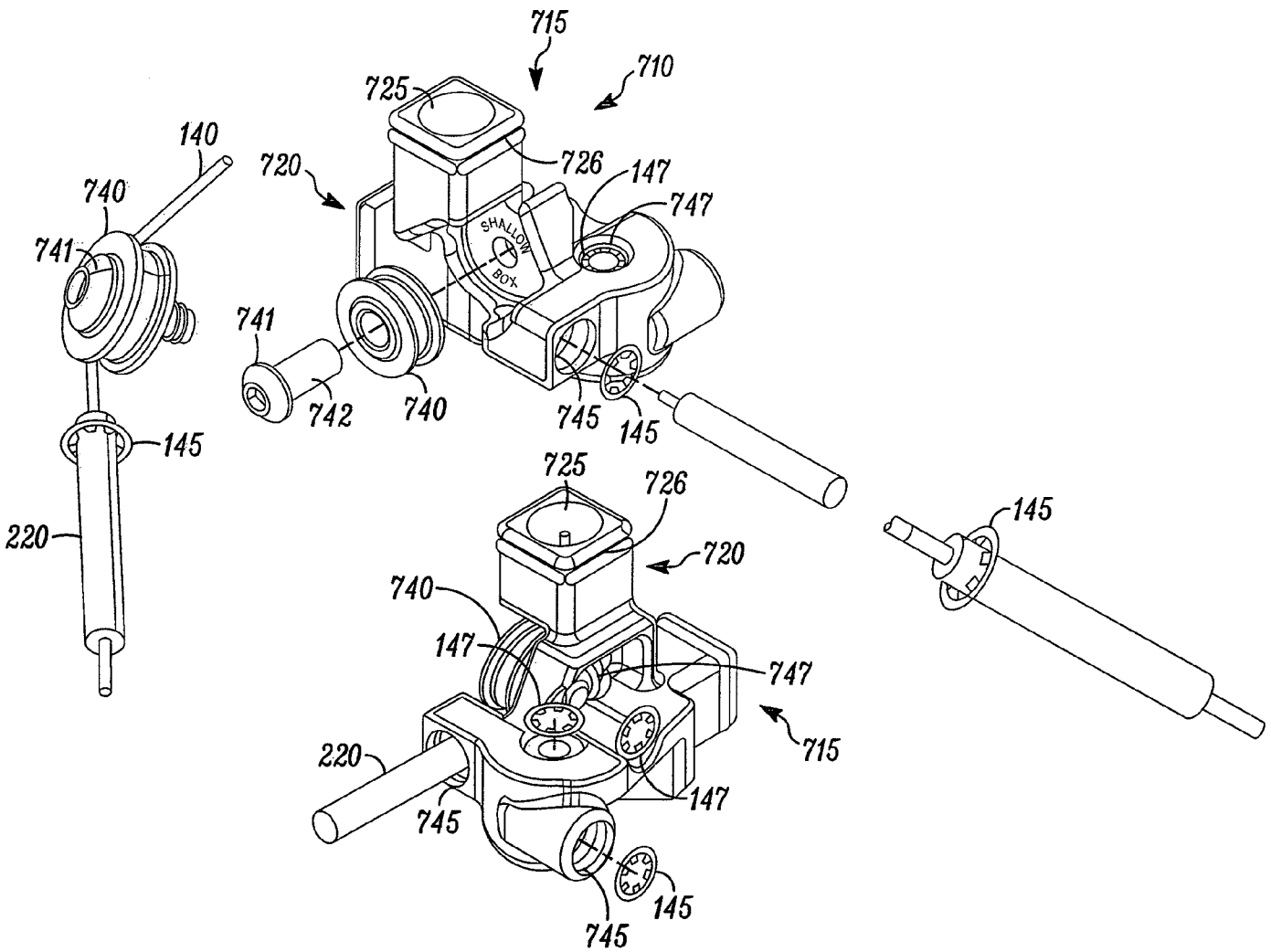
FIG. 10A is an exploded view of the pulley block with groove fit features.
Figure 10B:
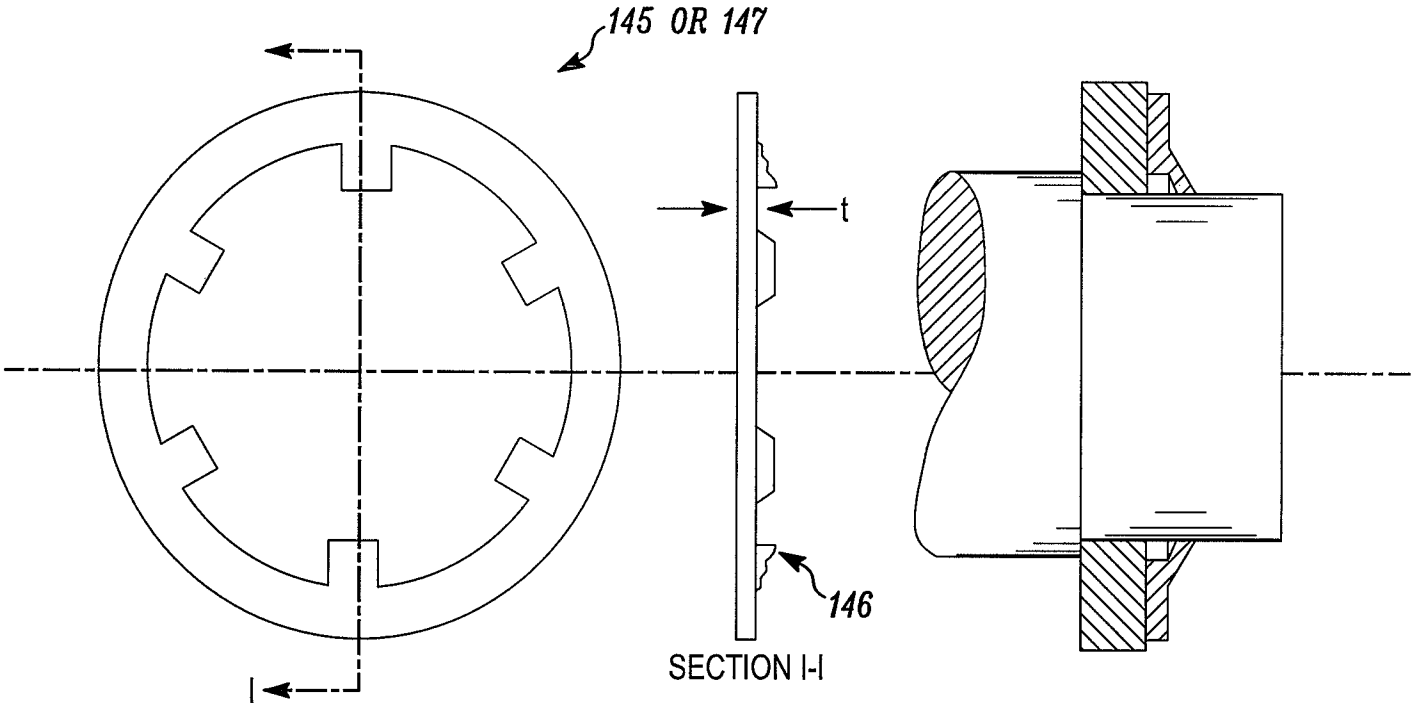
FIG. 10B is a front view and side view of the retaining clip and flexible conduit.
Figure 10C:
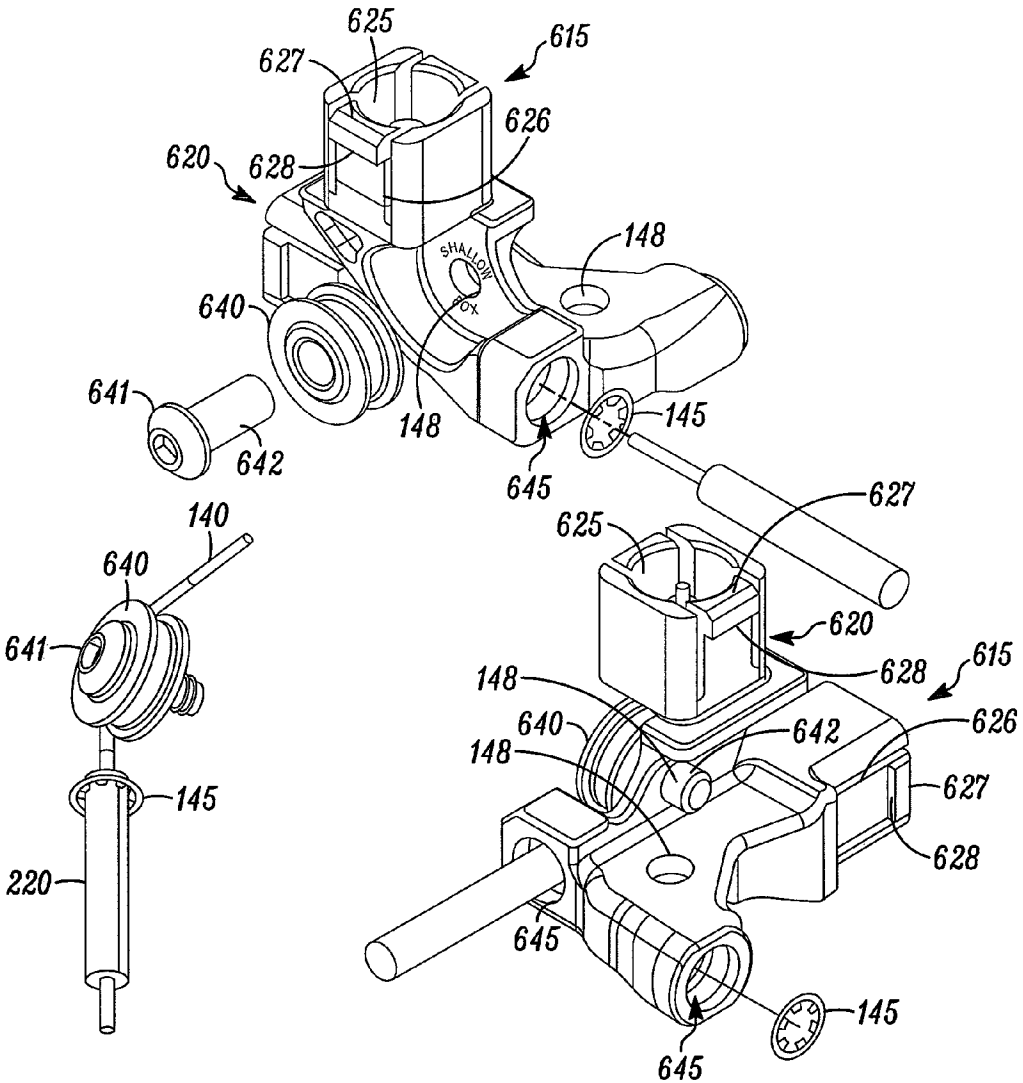
FIG. 10C is an exploded view of the pulley block with snap-fit features.

The pulley blocks 610 and 710 shown in FIGS. 10A and 10B may include a pulley 640 and 740 with bearings, or a pulley with a low friction bushing, in order to reduce the force necessary to pull the wire rope 140 out of the pull station when activating the pressurizing control cabinet 200, release mechanism 160. The pulley 640 or 740 may be connected to pulley block 610 or 710 using pulley axle screw threaded boss and pulley axle retaining clip 147. An example of the means by which to connect the pulley includes using pulley axle shaft 641 and threaded pulley axle 642 (for pulley 640), or pulley axle shaft 741 and threaded pulley axle 742 (for pulley 740). Alternatively, the pulley axle retaining clip 147 need not be used. For example, threaded pulley axle 742 may be turned into the pulley block to secure the pulley 640 or 740. FIG. 10A further illustrates a pull knob stem receiver 725, a cleat retaining boss for a flexible cable 745, and a cleat retaining boss for a pulley axle 747. FIG. 10C further illustrates a pull knob stem receiver 625, a snap cleat relief 626, a snap cleat locking surface 628, and a cleat retaining boss for a flexible cable 645.

The pulley blocks 610 and 710 may connect to the flexible conduit 220 using an integral or assembly assisting retaining clip 145. The retaining clip 145 may contain teeth or cleats 146 dimensioned such that the inner diameter (ID) of the clip is slightly less than the outer diameter (OD) of the flexible conduit 220 outer jacket 310 to enable positive engagement of the teeth or cleats 146 with the outer jacket 310. The teeth or cleats 146 may be angled in such a way to allow the flexible conduit to be inserted into the pulley blocks 610 or 710 using reasonable force by hand. Based on the predisposed angle of the teeth or cleats 146 as shown in FIGS. 10A and 10B, removal of the flexible conduit 220 from the pulley blocks 610 or 710 is made difficult and thus may require the use of a special tool. Alternatively, a crimp may be used in place of the retaining clip 145 to connect the flexible conduit 220 to the pulley blocks 610 or 710. The pulley blocks 610 or 710 may also include proper circular interface bosses at each wire rope 140 exit point to enable the pulley blocks 610 or 710 to couple directly to EMT conduit compression fittings or other forms of conduit castings or couplings.

Figure 11B:
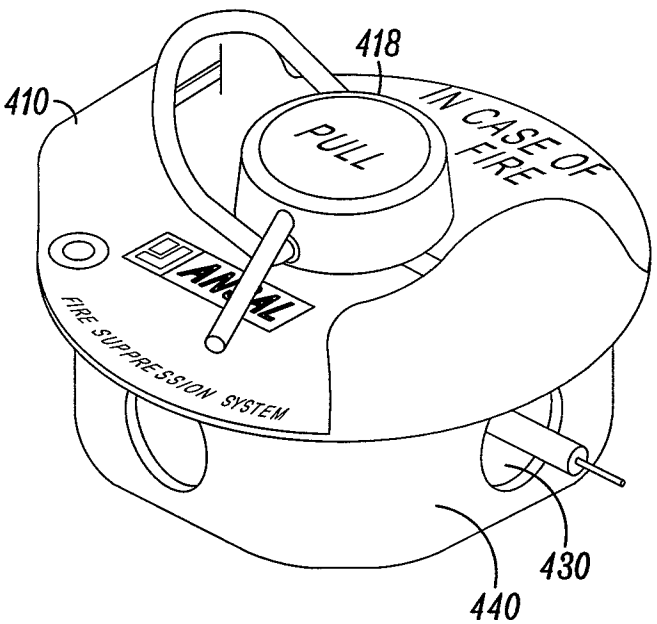
FIG. 11B is a front perspective view of the faceplate of the pull station and junction box with the pull knob rotated as depicted FIG. 11A.
Figure 11A:
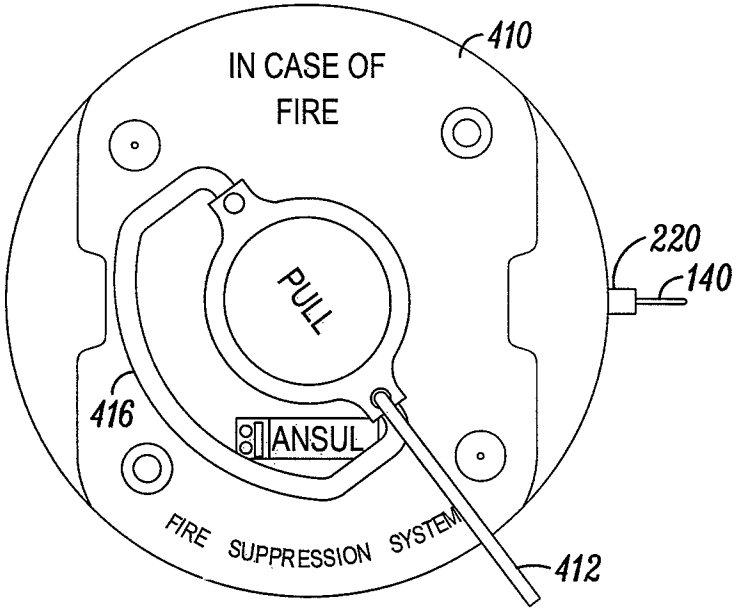
FIG. 11A is a front view of the faceplate of the pull station with the pull knob rotated.
Figure 11D:
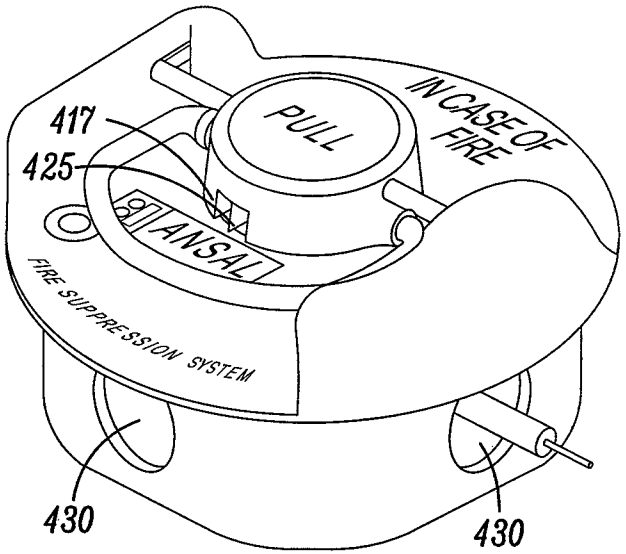
FIG. 11D is a front perspective view of the faceplate of the pull station and junction box with the pull knob not rotated as depicted FIG. 11C.
Figure 11C:
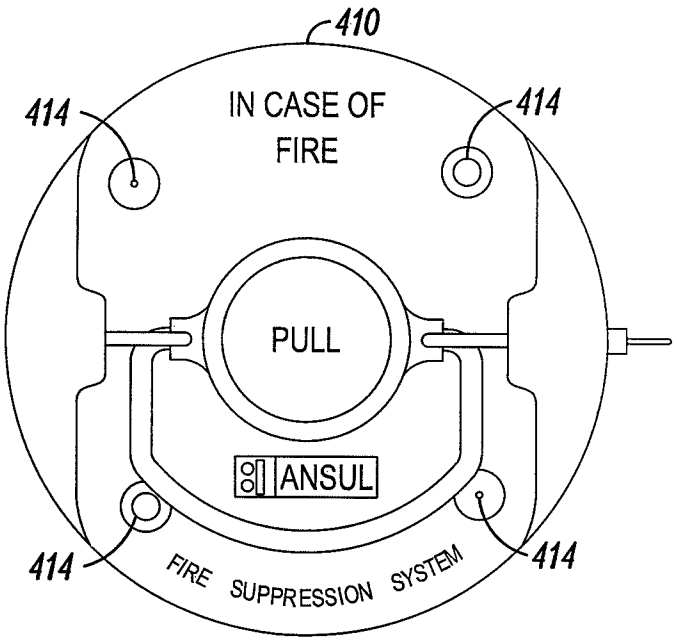
FIG. 11C is a front view of the faceplate of the pull station with the pull knob not rotated.
Figure 16A:
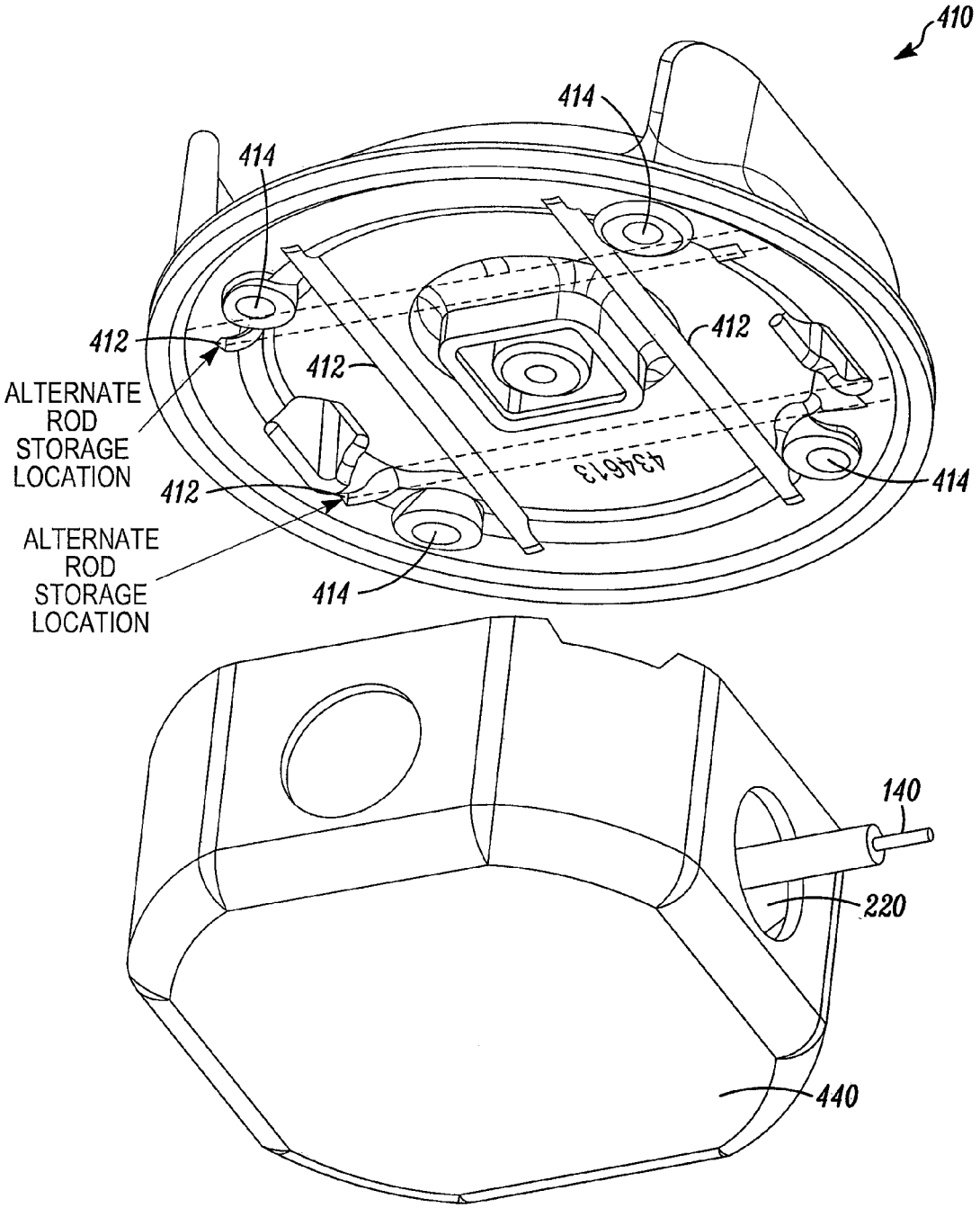
FIG. 16A is an exploded bottom perspective view of the junction box and faceplate with break rod storage mechanism.

The fire suppression system may include a faceplate 410 that is coupled to pulley blocks 610 and 710. The faceplate 410 may include lettering in one or more languages. The faceplate 410 may be coupled to pulley blocks 610 and 710 in several ways, including using one or more set screws 417 or snap lock features 627 (illustrated in FIG. 10C) that may couple the pulley blocks 610 and 710 into engagement with the faceplate 410. Alternatively, instead of set screws 417, a crimp connector may be used. The resulting combination is a faceplate 410/pulley block 610 or 710 coupled as an assembly. When the faceplate 410 is configured with the snap lock feature as shown in FIG. 9A, assembly of the pulley block 610 into the faceplate 410 may be accomplished by hand without tools. The snap lock feature, as described herein and depicted in FIG. 9A, enables a faceplate-to-pull knob snap lock feature 425 to be utilized for locking the pull knob body 418 in a normal rotational orientation as shown in FIGS. 11C-D and 16E. The snap lock feature 425 may be used to engage the pull knob body 418 into place once the pull knob body 418 is rotated into its final position. In this way, the pull knob body 418 may be rotated relative to the faceplate 410. Alternatively, the pull knob body 418 may remain stationary and the faceplate 410 may be rotated. The faceplate 410 may include one or more faceplate center pulley block receiver walls 421 and a faceplate center pulley block receiver step lock 422, as shown in FIG. 16E.

Figure 12A:
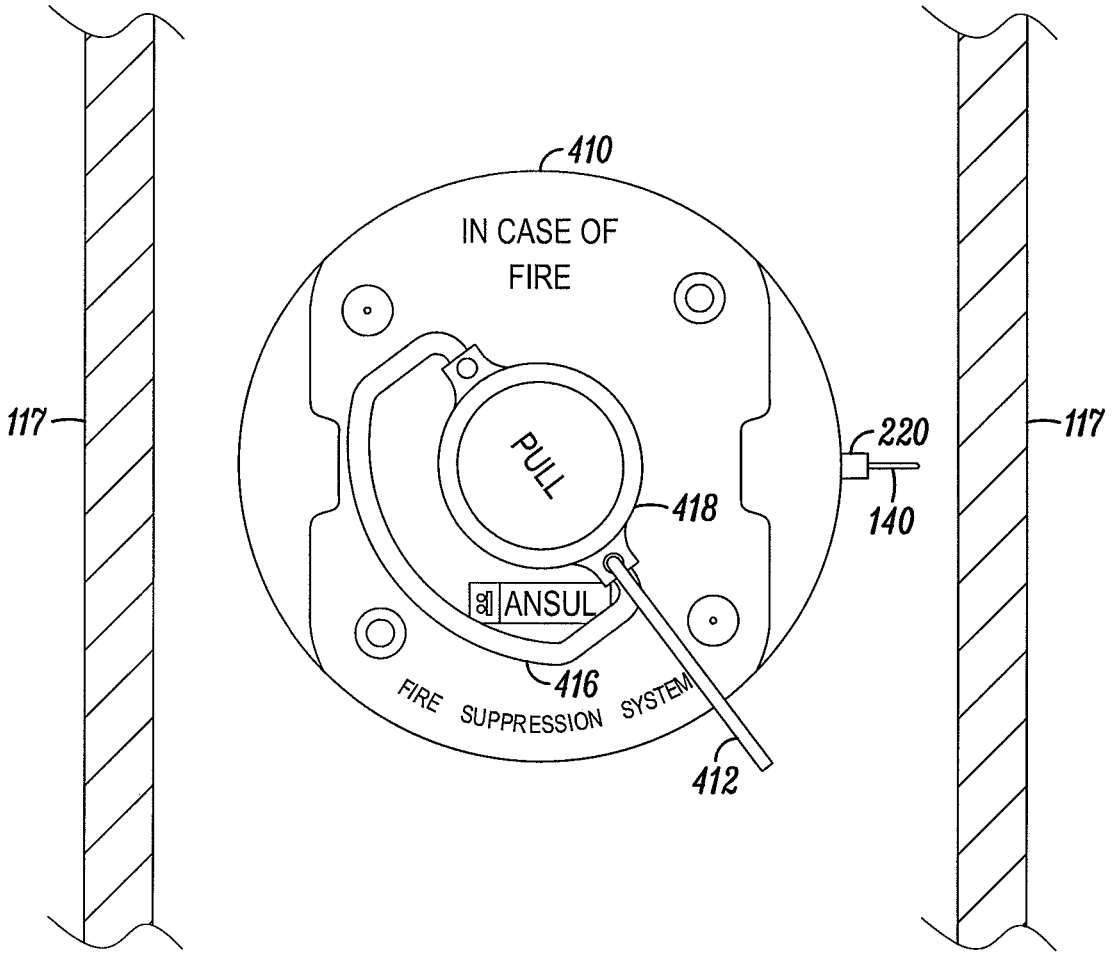
FIG. 12A is a front view of the faceplate of the pull station with the pull knob rotated and with walls proximate to the pull station.
Figure 12B:
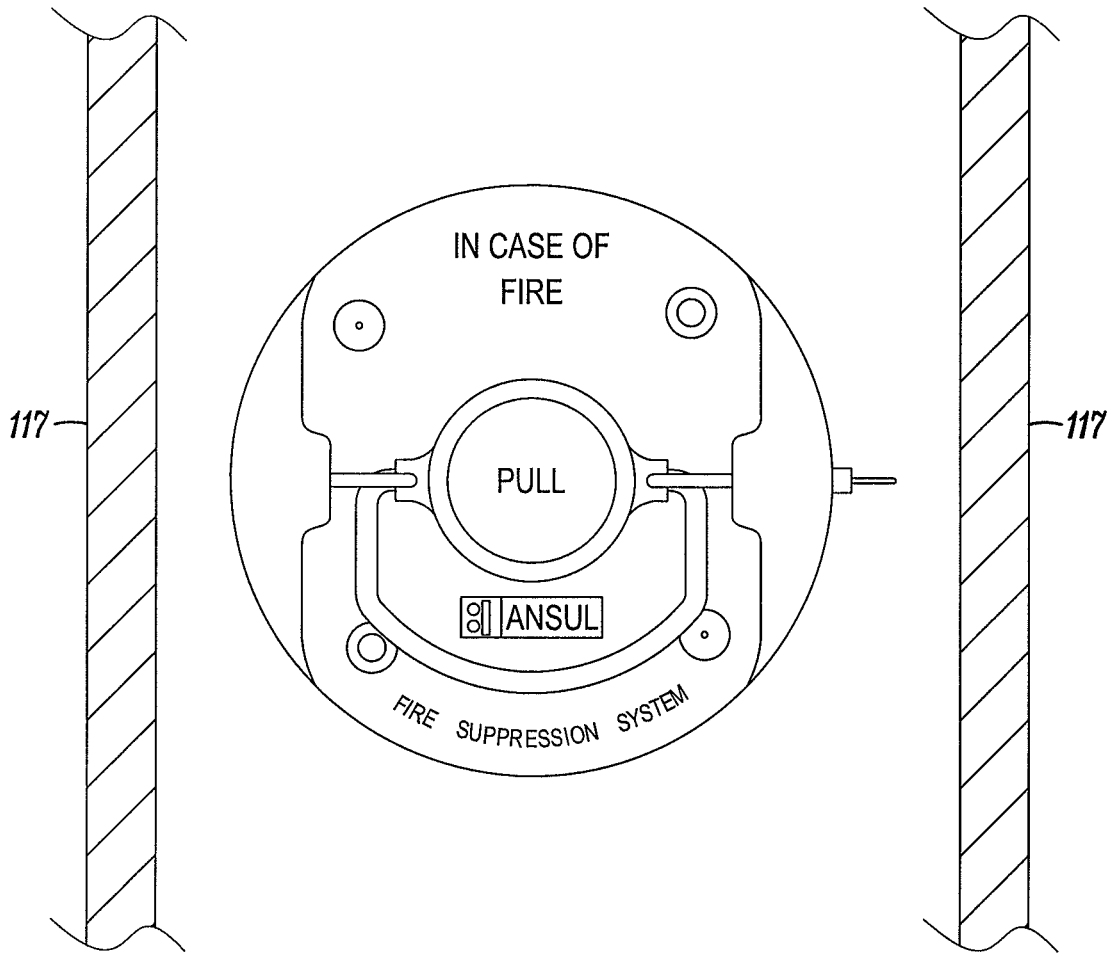
FIG. 12B is a front view of the faceplate of the pull station with the pull knob not rotated and with walls proximate to the pull station.
Figure 12C:
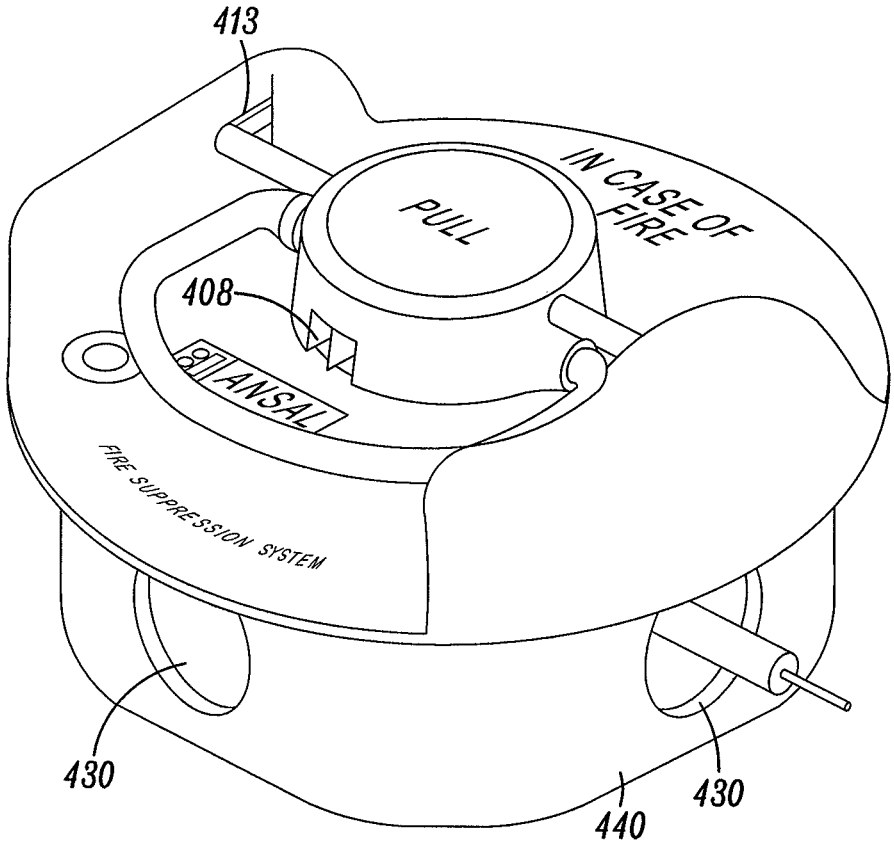
FIG. 12C is a front perspective view of the faceplate of the pull station and junction box with the pull knob not rotated as depicted FIG. 12B.

The snap lock feature 425 enables the pull knob body 418 to be rotated, such as rotated sufficiently clockwise to allow the break rod 412 to be inserted into the pull knob body 418 in preparation for setting the pull station to a normal orientation as shown in FIGS. 11A-D. Insertion of the break rod 412 may thus be accomplished in areas where there is adequate wall space on each side of the pull station and also within the narrow wall confines. This is illustrated in FIGS. 12A-C in which wall 117 is proximate to the faceplate 410. In order to insert break rod 412, the pull knob body 418 is rotated clockwise (illustrated in FIG. 12A), and after installation of the break rod, rotated counterclockwise (illustrated in FIG. 12B). While the pull knob body 418 is being rotated counterclockwise towards the snap lock position, the snap lock cleat 425 may remain compressed until it moves into the corresponding relief 409 contained within the pull knob body as shown in FIGS. 10D-I and 13E.

The pull station 400 includes pull handle cap 390, cap snap fit boss 391, and cap body snap fit receiving boss 392, as shown in FIG. 9*a*. A crimp stop 141 may be used to hold pull handle cap 390. The crimp stop 141 is one example of a cable compression connection. Another example of a cable compression connection may comprise a compression fitting, which may be used in place of crimp stop 141. FIG. 9A further shows a cross hole for break rod 401, a relief hole for wire rope stopper 402, a ring handle hole 403, and a tool slot 404.

Figure 16B:
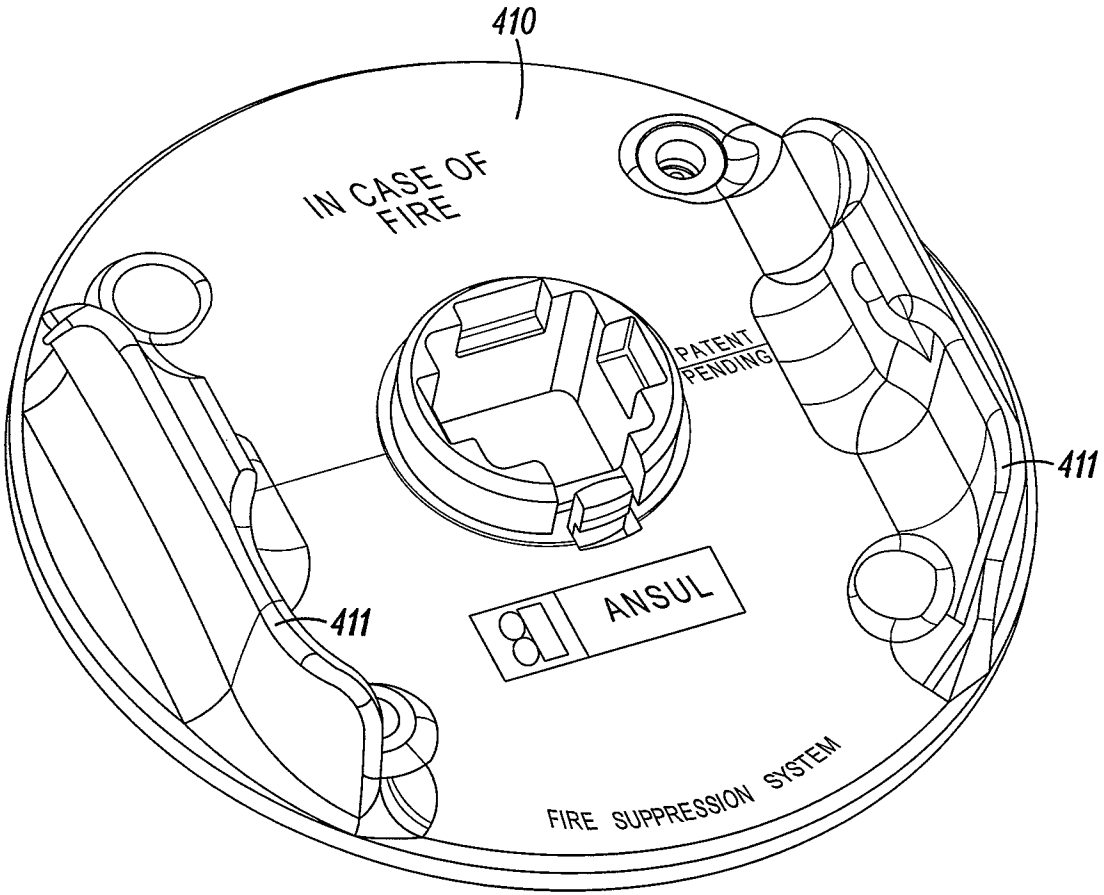
FIG. 16B is a top perspective view of the faceplate.
Figure 16C:
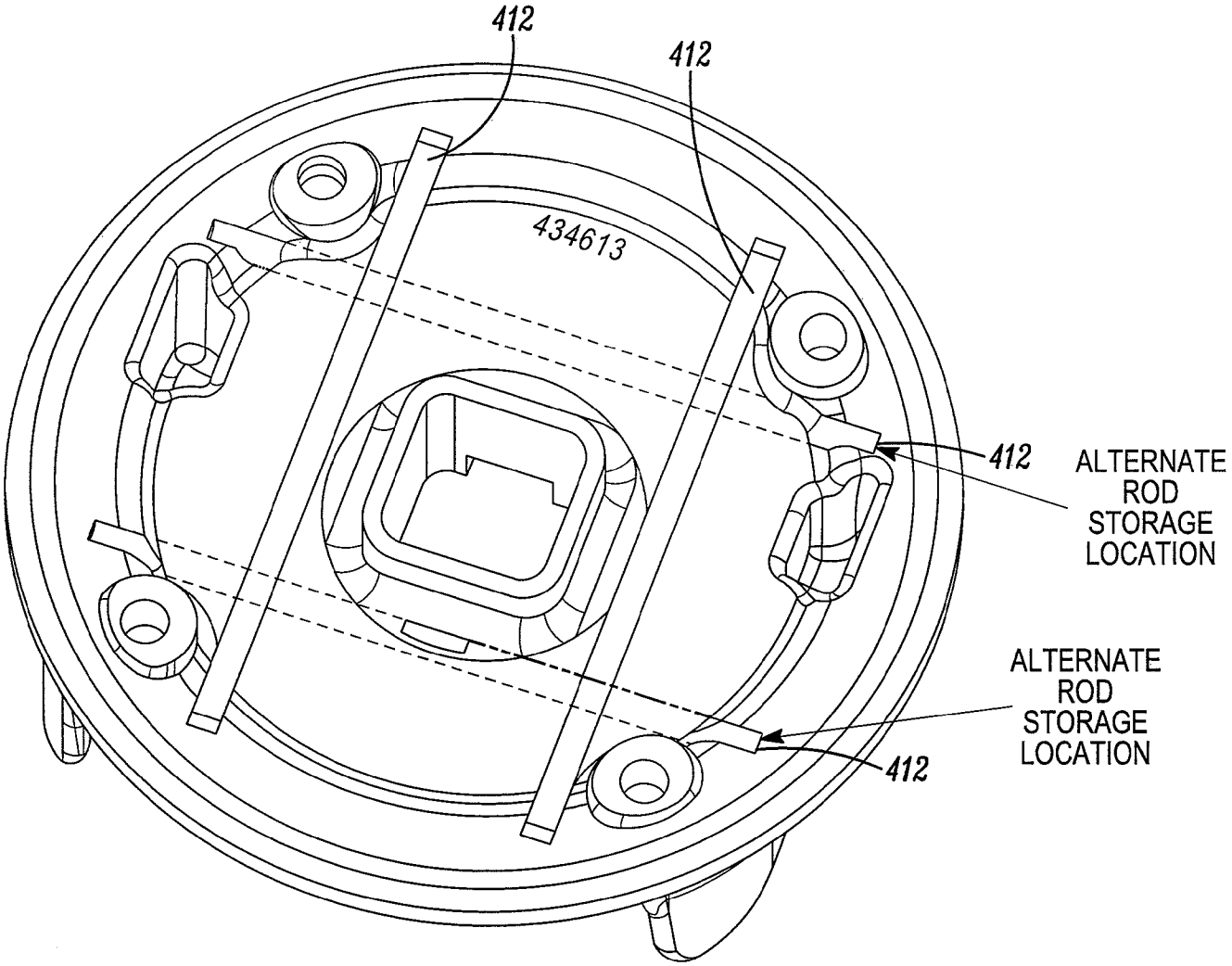
FIG. 16C is a bottom perspective view of the faceplate illustrating storage of the additional break rods.
Figure 16D:
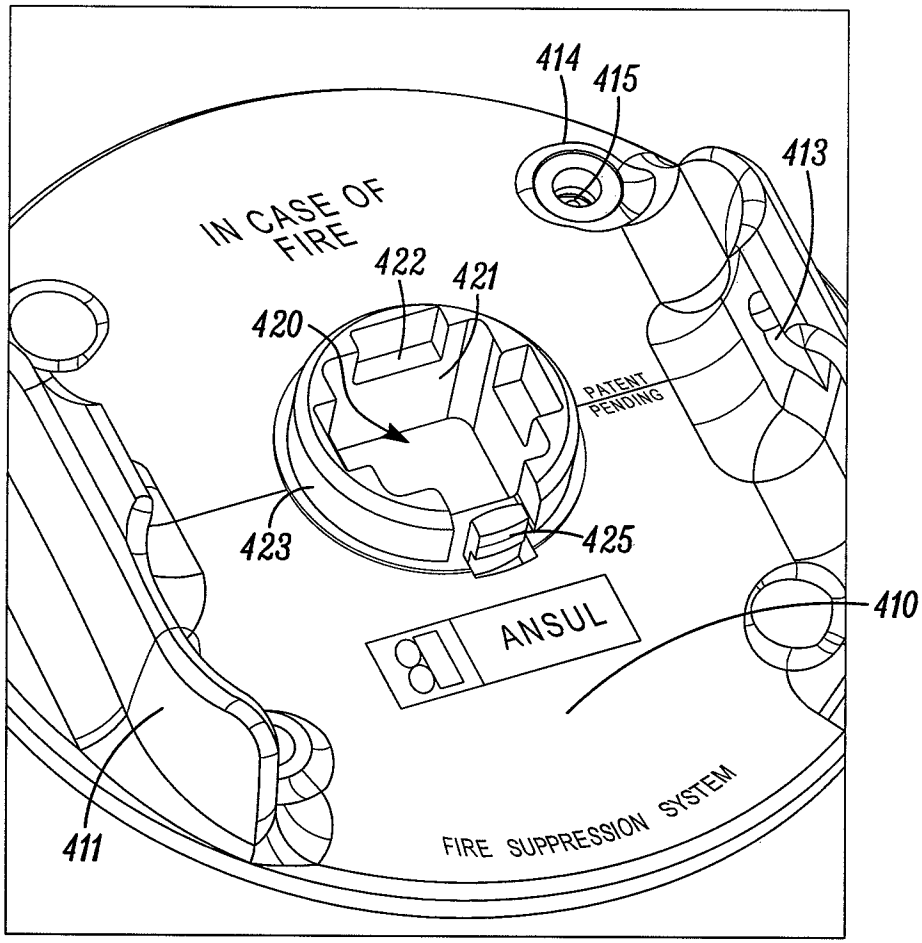
FIG. 16D is a front perspective view of a portion of the faceplate.
Figure 16E:
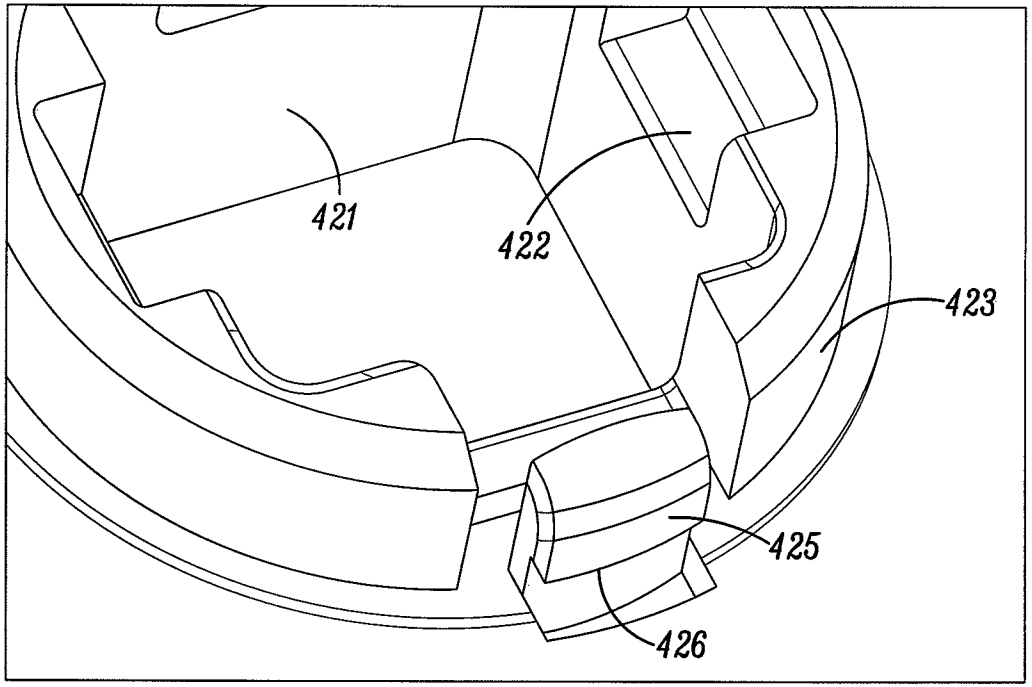
FIG. 16E is a front perspective view of a portion of the faceplate illustrating the snap cleat.

The faceplate 410 may contain one or more protective side walls 411, such as one on each side of the pull knob body 418 and pull handle 416 assembly as shown in FIGS. 16B and 16D. The protective walls 411 may provide a robust barrier to protect the pull knob body 418 and pull handle 416 against inadvertent side impact by foreign objects. These protective side walls 411 may also provide slots 413 for receiving the ends of the break rods 412 when installed, illustrated in FIG. 17A-C. Further, the faceplate 410 may include a pull handle circular race of faceplate 423 and a pull knob set screw threaded boss 424.

Figure 13A:
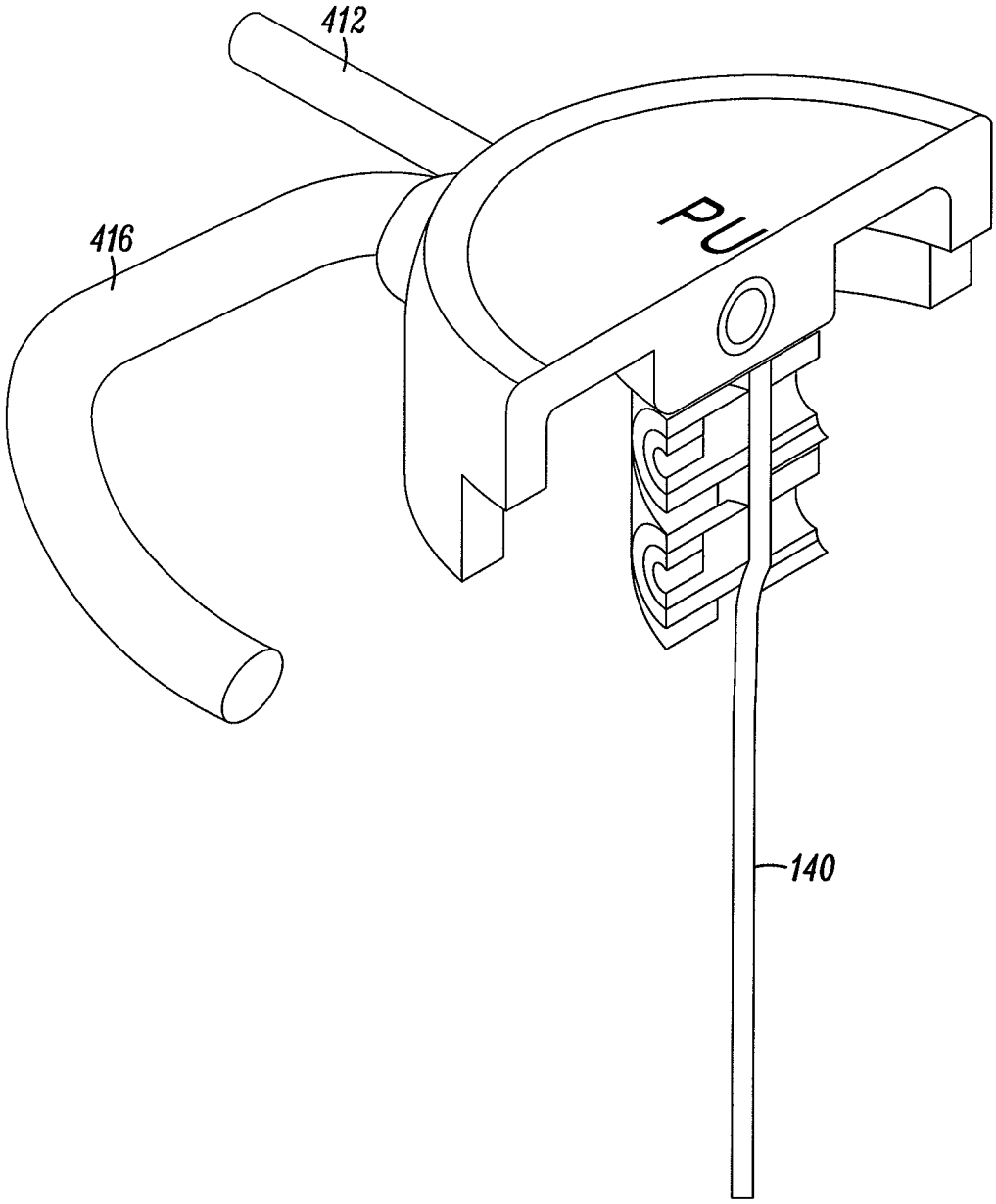
FIG. 13A is a perspective cross-section of the pull knob, wire rope, and the set screws holding the wire rope.
Figure 13B:
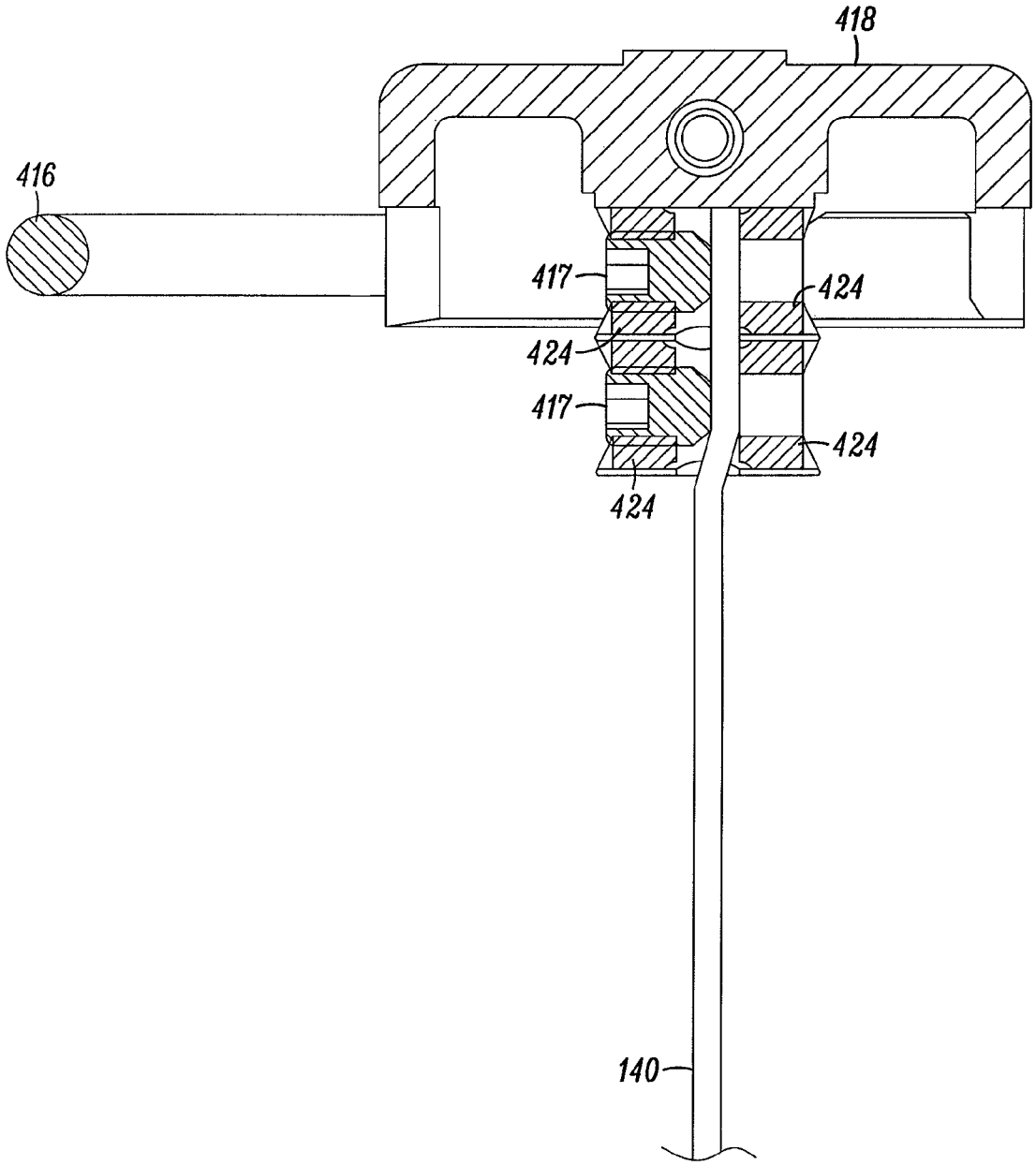
FIG. 13B is a cross-section of the pull knob, wire rope, and the set screws holding the wire rope as depicted in FIG. 13A.
Figure 13C:
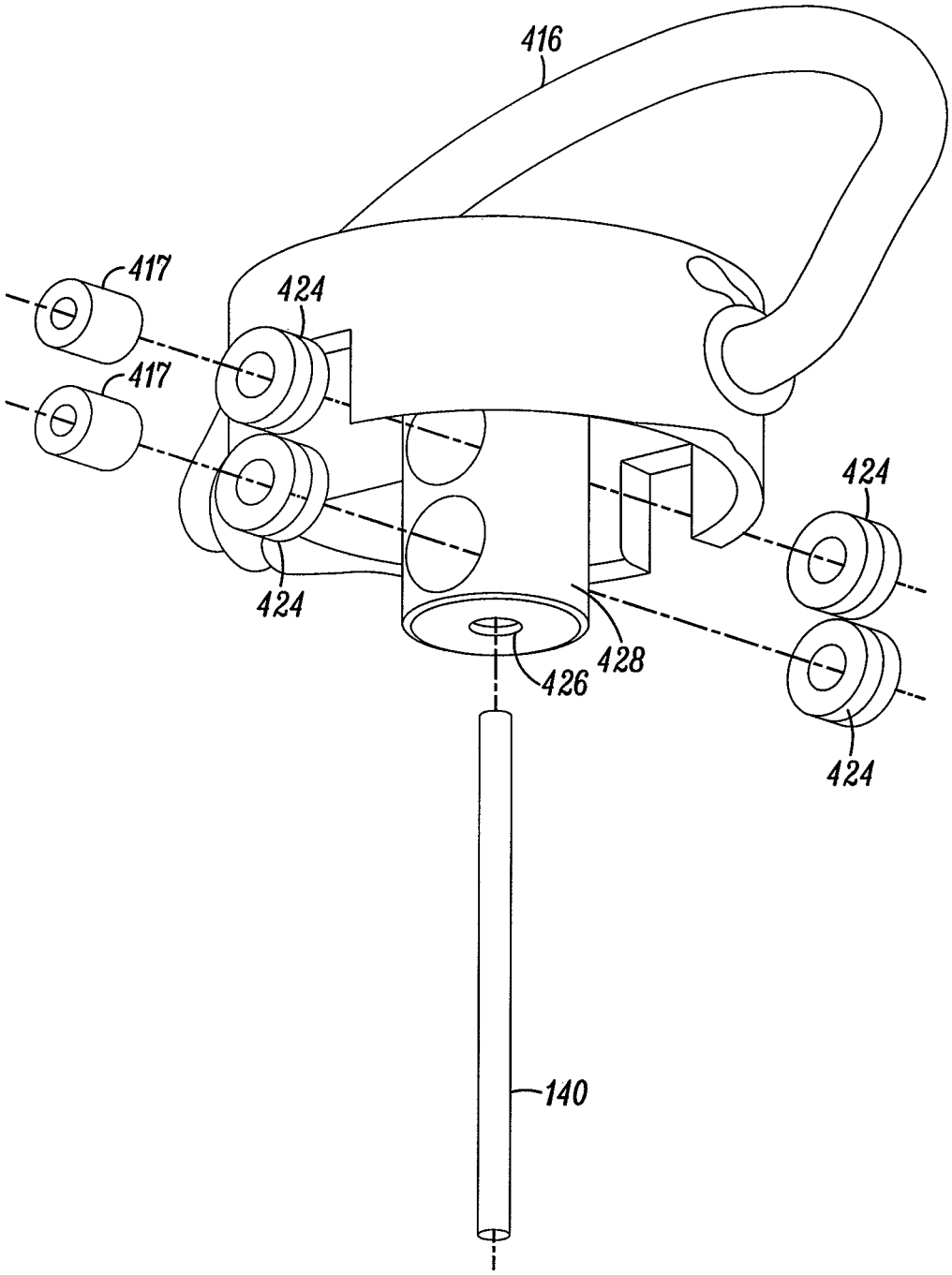
FIG. 13C is an exploded view of the pull knob, wire rope, and the set screws holding the wire rope as depicted in FIG. 13A.
Figure 13D:
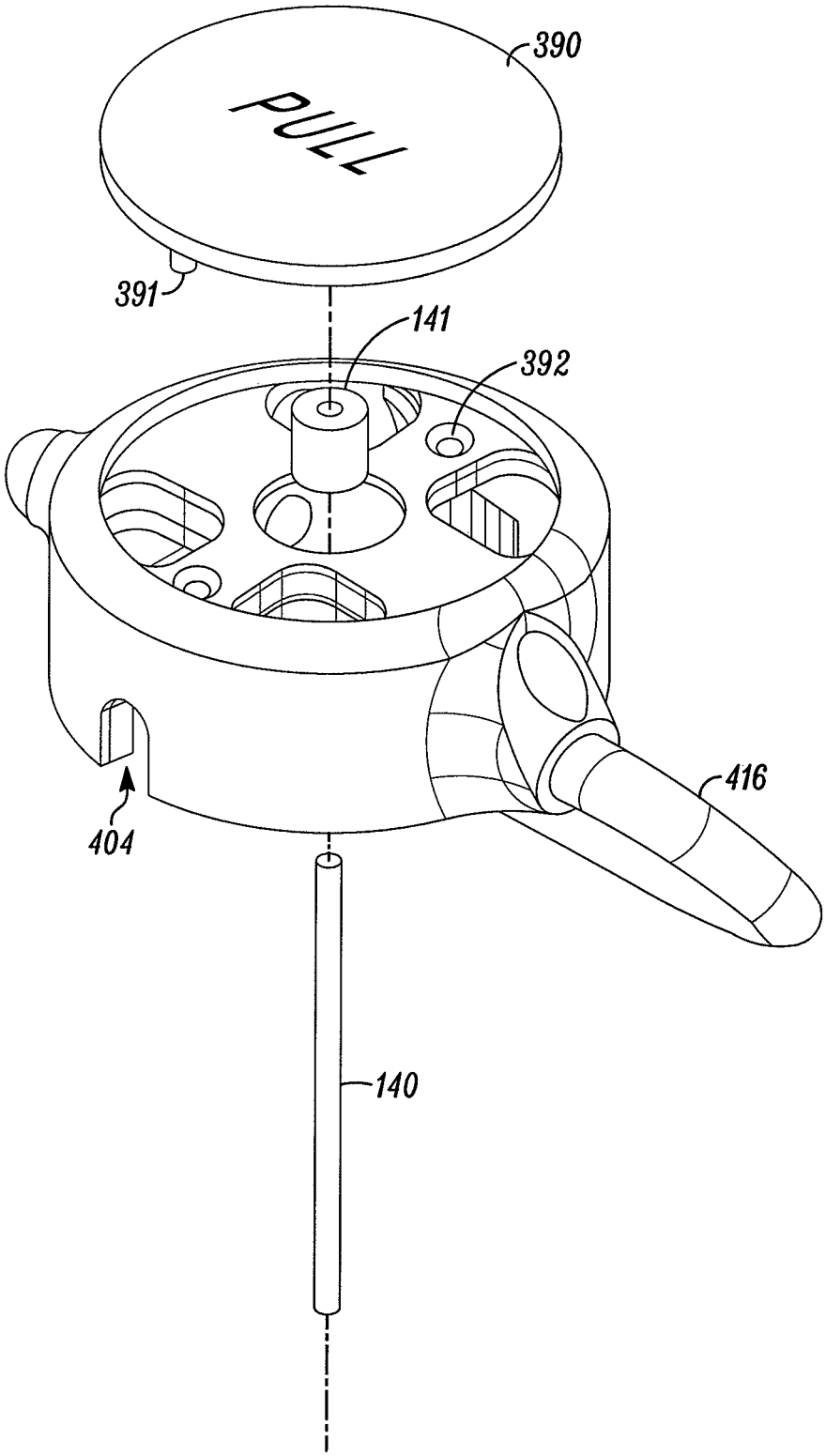
FIG. 13D is a top perspective exploded view of the pull knob, wire rope, and compression fitting capturing the wire rope.
Figure 13E:
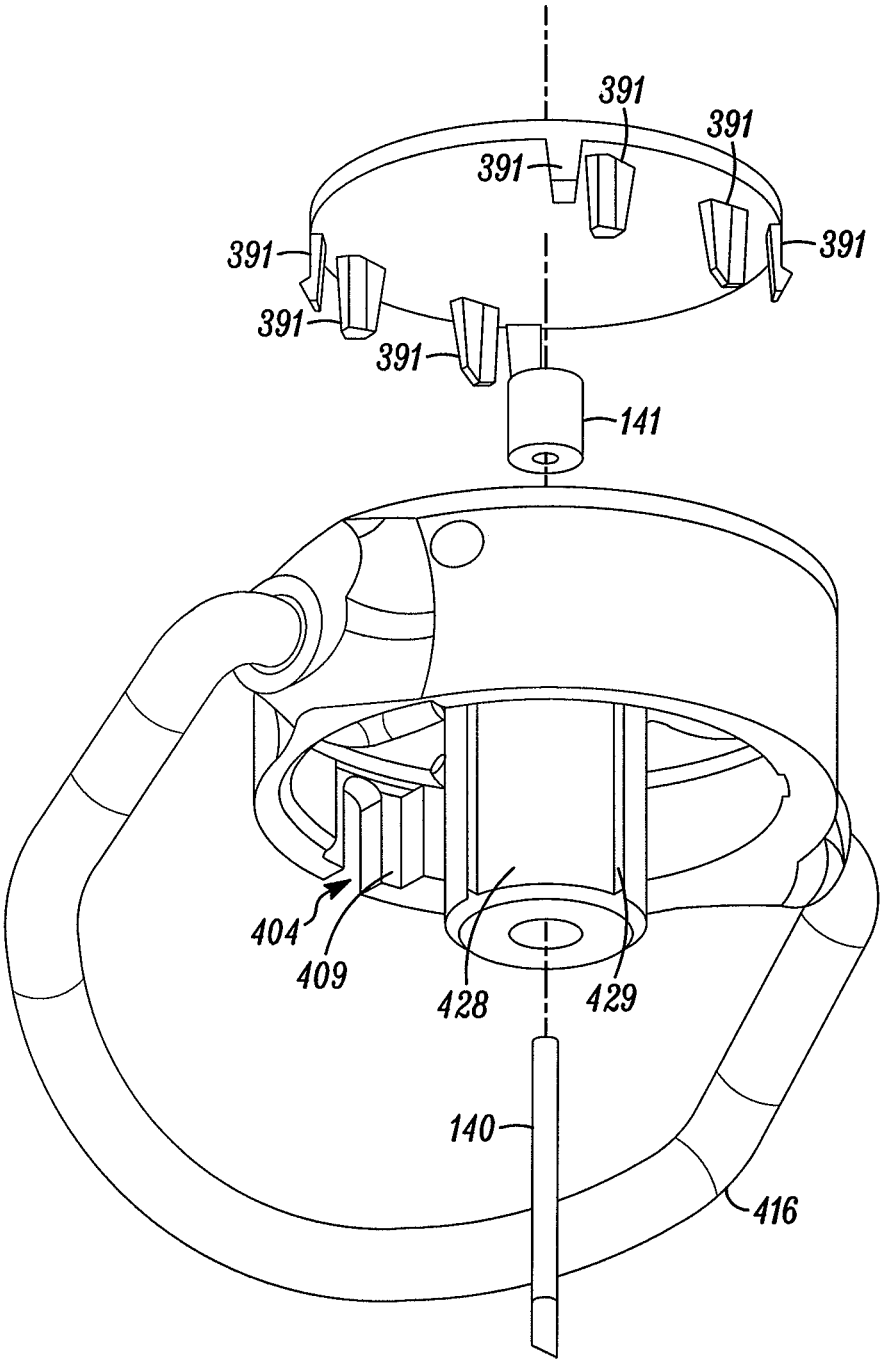
FIG. 13E is a bottom perspective exploded view of the pull knob, and wire rope capturing the wire rope as depicted in FIG. 13D.
Figure 13F:
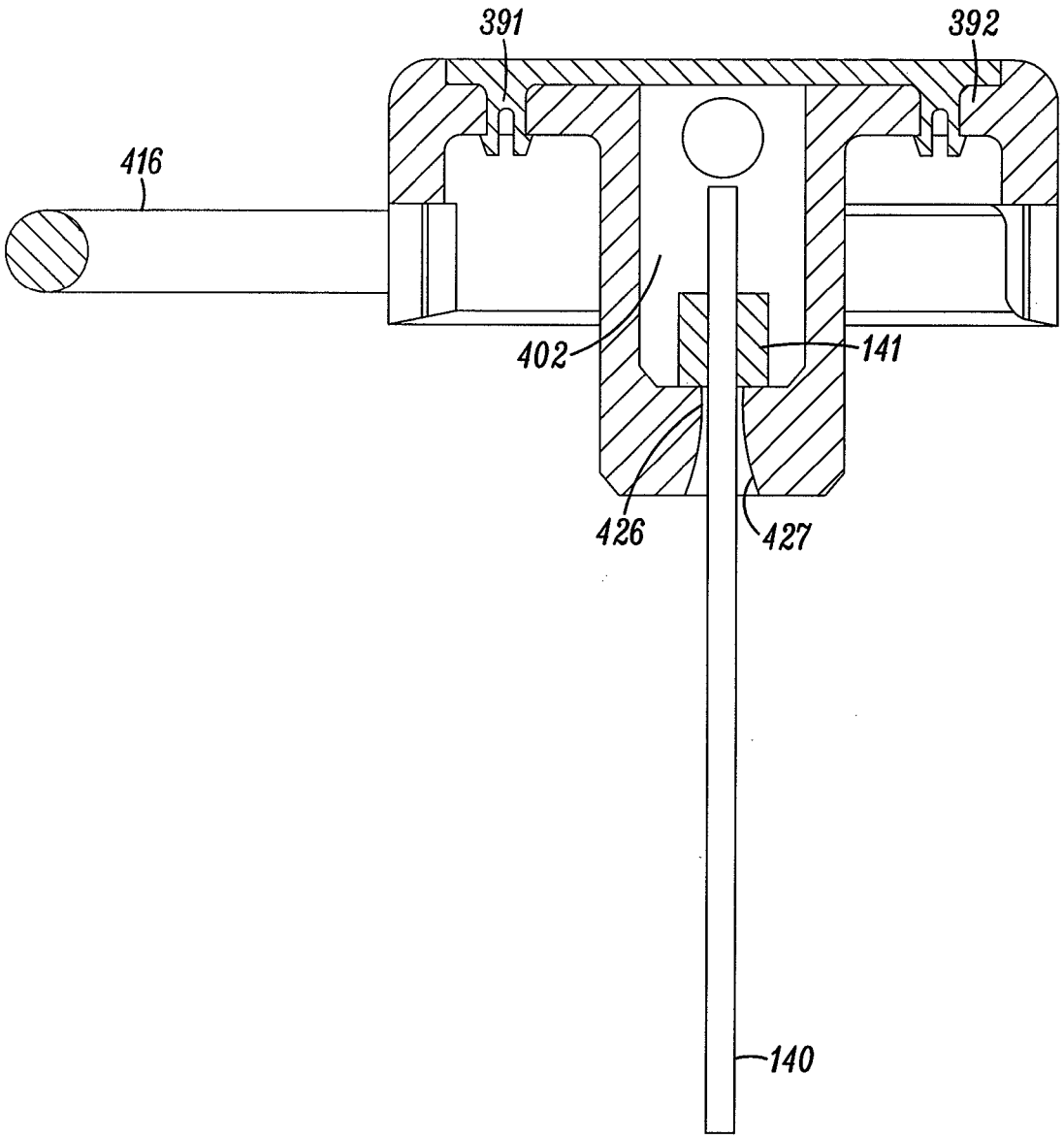
FIG. 13F is a cross-section of the pull knob, wire rope, and compression fitting capturing the wire rope as depicted in FIG. 13D.

Activation of the pull station may be accomplished by pulling the pull knob body 418 away from the pull station 400. This action may cause the break rod 412 to fracture allowing the pull knob body 418 to move away from the faceplate 410 and thus moving the wire rope 140 through the flexible conduit 220, thereby activating the release mechanism 160. Coupling of the wire rope 140 to the pull knob body 418 may be accomplished in several ways, such as shown in FIG. 9B. Two methods are provided for illustration purposes only. The first method, as illustrated in FIGS. 13A-C, uses one or more set screws 417 to secure the wire rope 140 into fixed or permanent configuration with the pull knob body 418. In this configuration, the wire rope 140 may be threaded into the wire rope recess 426 of the pull handle cable boss 428, such as shown in FIG. 13C. Set screws 417 may be tensioned against the wire rope 140 to cause a sufficient binding on the wire rope to prevent it from being removed, such as shown in FIG. 6. As discussed above, set screws 417 need not be used and alternative methodologies, such as using a crimp connector, may be used. The second method, as illustrated in FIGS. 13D-F, uses a compression fitting 141 to create an oversized end of wire rope coupling to inhibit or prevent the wire rope 140 from being removed from the pull knob body 418. In this configuration, the OD of the compression fitting 141 may be larger than the OD of the wire rope access hole 426 in order that removal of the wire rope 140 from the pull knob body 418 is inhibited or prevented.

The faceplate 410 may also contain containment boundary diaphragms 415 (illustrated in FIG. 16D) located in each faceplate 410 mounting screw boss 414, (illustrated in FIGS. 9A-B and 16D). The containment boundary diaphragms 415 may be used to reduce or minimize any contaminate such as grease, dirt or grime from penetrating the faceplate 410 outer surface and entering into the working components and/or wire rope conduit 140 or 200 sections of the pull station assembly, such as shown in FIG. 11A.

Figure 10D:
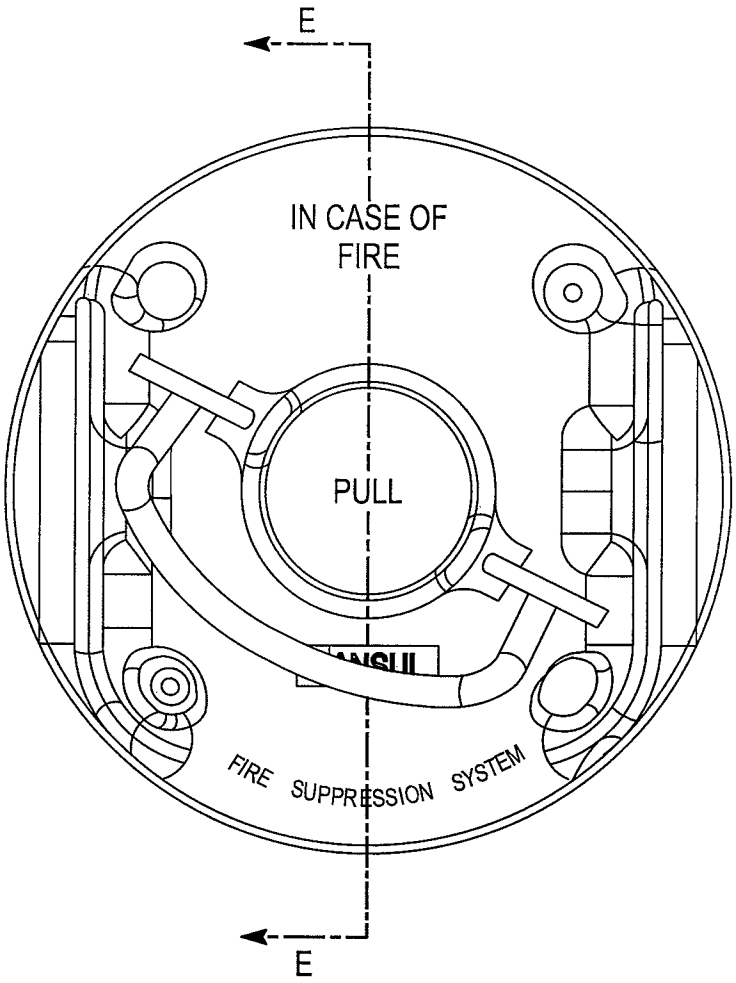
FIG. 10D is a front view of the pull station pull knob rotated relative to the faceplate.
Figure 10F:
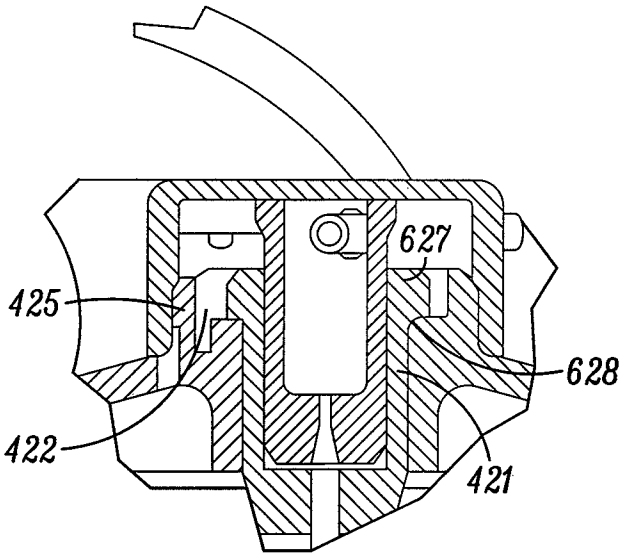
FIG. 10F is an exploded portion (detail F) from FIG. 10E.
Figure 10E:
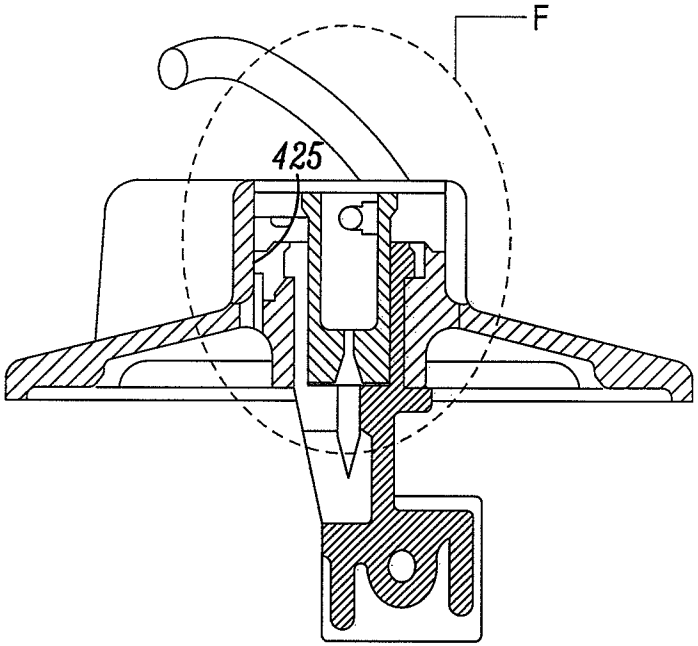
FIG. 10E is a cross-section (E-E) from FIG. 10D.
Figure 10G:
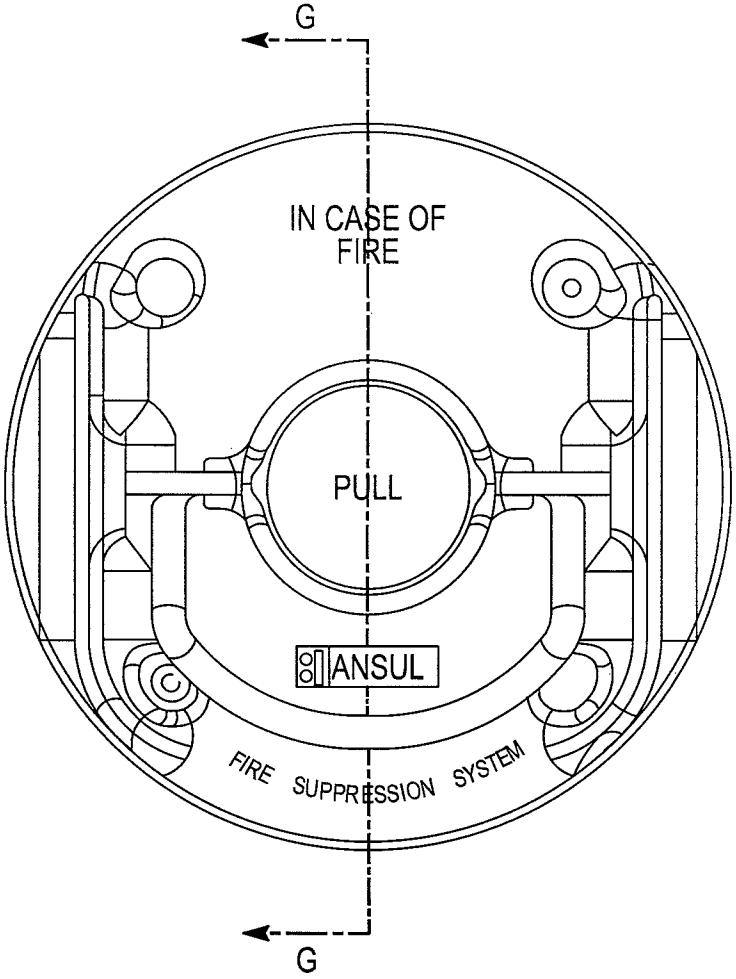
FIG. 10G is a front view of the pull station pull knob of the faceplate assembly not rotated.
Figure 10I:
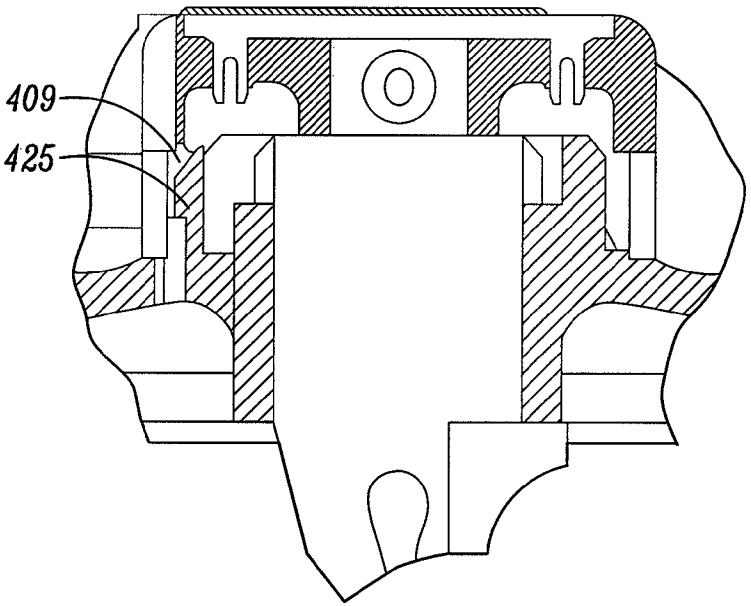
FIG. 10I is an exploded portion (detail H) from FIG. 10H.
Figure 10H:
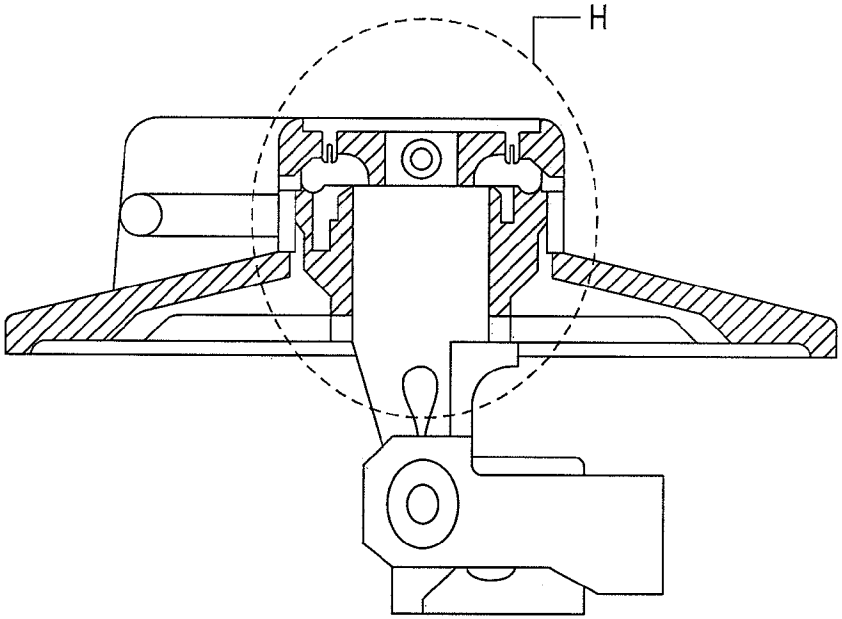
FIG. 10H is a cross-section (G-G) from FIG. 10G.
Figure 10J:
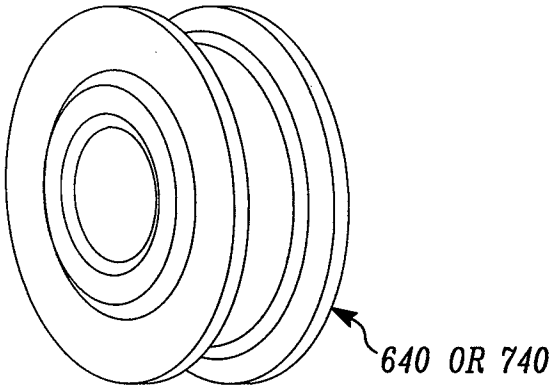
FIG. 10J is a perspective view of the pulley block pulley.
Figure 10L:
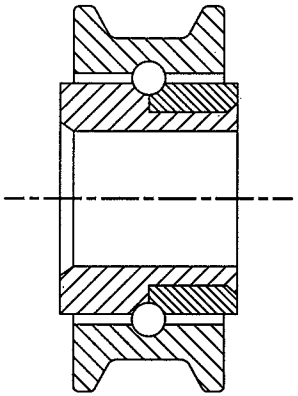
FIG. 10L is a cross-section (A-A) from FIG. 10K.
Figure 10K:
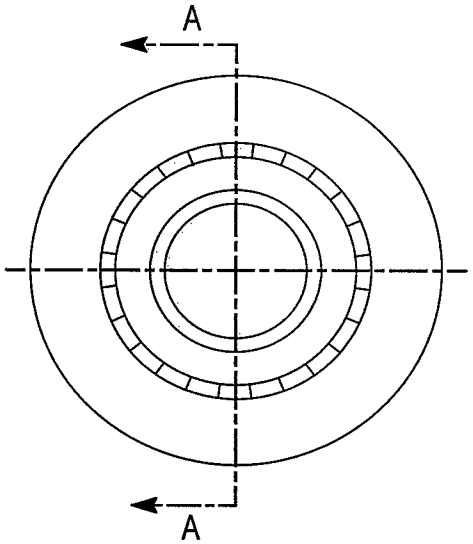
FIG. 10K is a front view of the pulley block pulley shown in FIG. 10J.

The faceplate 410 and/or the pull handle cap 390 may further include various indicia, such as words, as shown in FIGS. 9A-B and 10D. The indicia may be of a color that is different from another portion of the faceplate 410 and the pull handle cap 390.

For example, the color may be red, fluorescent, or glow in the dark in order to differentiate the words (and the faceplate) from the surroundings (such as an aluminum background). The break rod 412 may be composed of plastic or glass and therefore may be transparent or opaque. The color on the faceplate 410 may be highlighted when viewed through the break rod 412. Moreover, a part (or all) of the pull handle 416, break rod 412, screw boss 414, or containment boundary diaphragms 415 may be of a color that is different from another portion of the pull handle 416, break rod 412, screw boss 414, or containment boundary diaphragms 415. Or, the pull handle 416, break rod 412, screw boss 414, or containment boundary diaphragms 415 may entirely be red, fluorescent, or glow in the dark in order to differentiate it from an adjacent part. Finally, the colors of two parts that are designed to mate may be selected such that the colors match when installed properly (e.g., continuous color red for screw boss 414 and containment boundary diaphragm 415 if they are installed properly) or such that the colors are different when installed properly (e.g., color red next to color aluminum when screw boss 414 is installed properly with containment boundary diaphragm 415).

The faceplate 410 may further be adapted to serve as a storage mechanism for service items, such as extra break rods 412. One method is shown in FIGS. 16A and 16B. In the event that the pull station 400 needs to be reconfigured or reinitialized, such as by inserting a new break rod, the hardware used for the reinitializing may be stored proximate to the pull station 400, such as storing additional break rods 412 on an underside of the faceplate 410, as shown in FIG. 16A. The break rods 412 may be stored at a 90° angle to that depicted in FIGS. 16A and 16C.

Figure 15A:
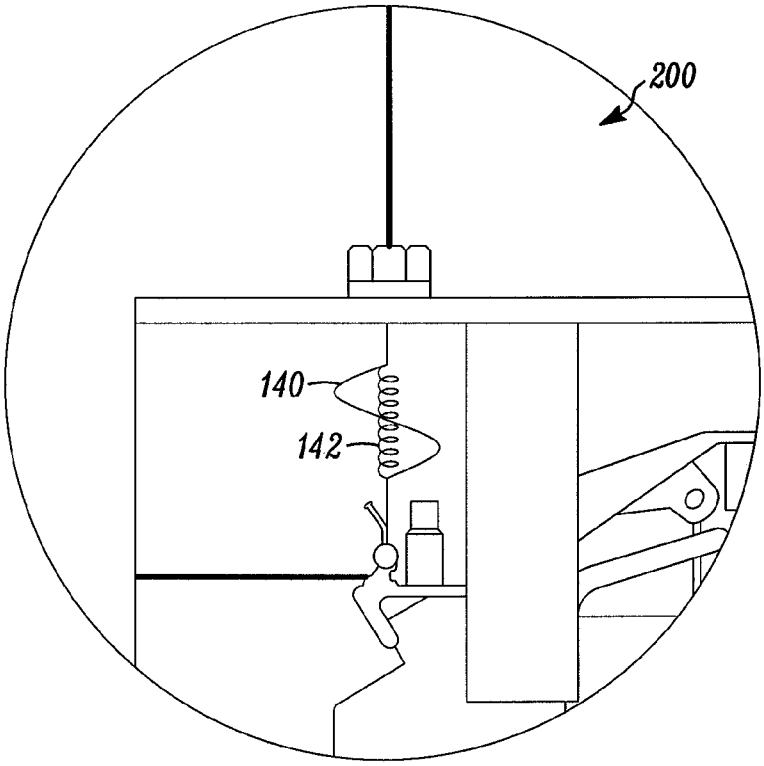
FIG. 15A is an exploded view of the auto wire rope tensioning mechanism illustrated in FIG. 14.
Figure 15B:
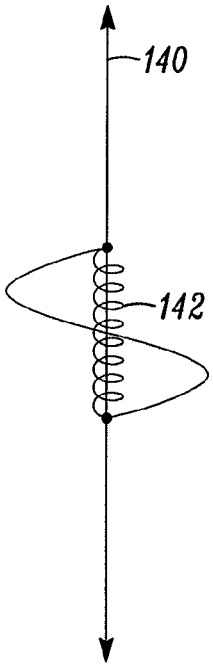
FIG. 15B is an illustration of the auto wire rope tensioning mechanism compressed.
Figure 15C:
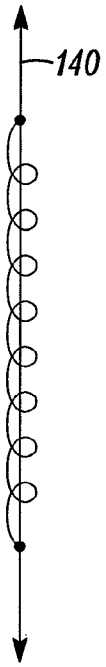
FIG. 15C is an illustration of the auto wire rope tensioning mechanism extended fully.
Figure 15D:
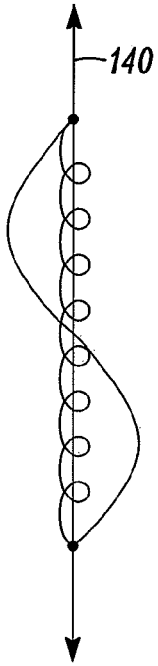
FIG. 15D is an illustration of the auto wire rope tensioning mechanism with partial movement pull testing from the pull station.

When the pull station 400 is installed in the field, the technician may often leave extra wire rope 140 inside the pressurizing control cabinet 200. This extra length of wire rope 140 may have the effect of allowing the pull knob body 418 to move away from the pull station 410 without activation of the release mechanism 160. A wire rope auto tensioning device may be used to control the "dead band" of wire rope 140 and maintain the wire rope 140 under tension, though this is not required. One example of an auto tensioning device comprises an auto tensioning spring 142, illustrated in FIGS. 15A-D. The auto tensioning spring 142 may be used to reduce the "dead band", as shown in FIGS. 15A-B. The auto tensioning spring 142 may allow the technician the ability to field test the conduit 130 or 220 routing without activating the system, as illustrated in FIG. 15D, by partial movement pull testing from the pull station. For example, a single technician located at the pull station 400 may pull the pull handle 416 in order to test the device. If after pulling the pull handle 416, the handle returns to its position (i.e., springs back), then the technician may determine that the auto tensioning spring 142 is operational and the wire rope is properly configured. The auto tensioning spring 142 may further ensure activation of the system upon deployment of the pull knob body 418, as illustrated in FIG. 15C, by extended full movement.

As shown in FIG. 15A, the auto tensioning device (such as the auto tensioning spring 142) is located proximate to the release mechanism 160. Alternatively, the auto tensioning device may be located at any point along the path of the wire rope 140 from the pull station 400 to the release mechanism 160. The auto tensioning device may comprise a variety of shapes, such as a "Z" shaped spring, as shown in FIG. 15A.

Figure 14:
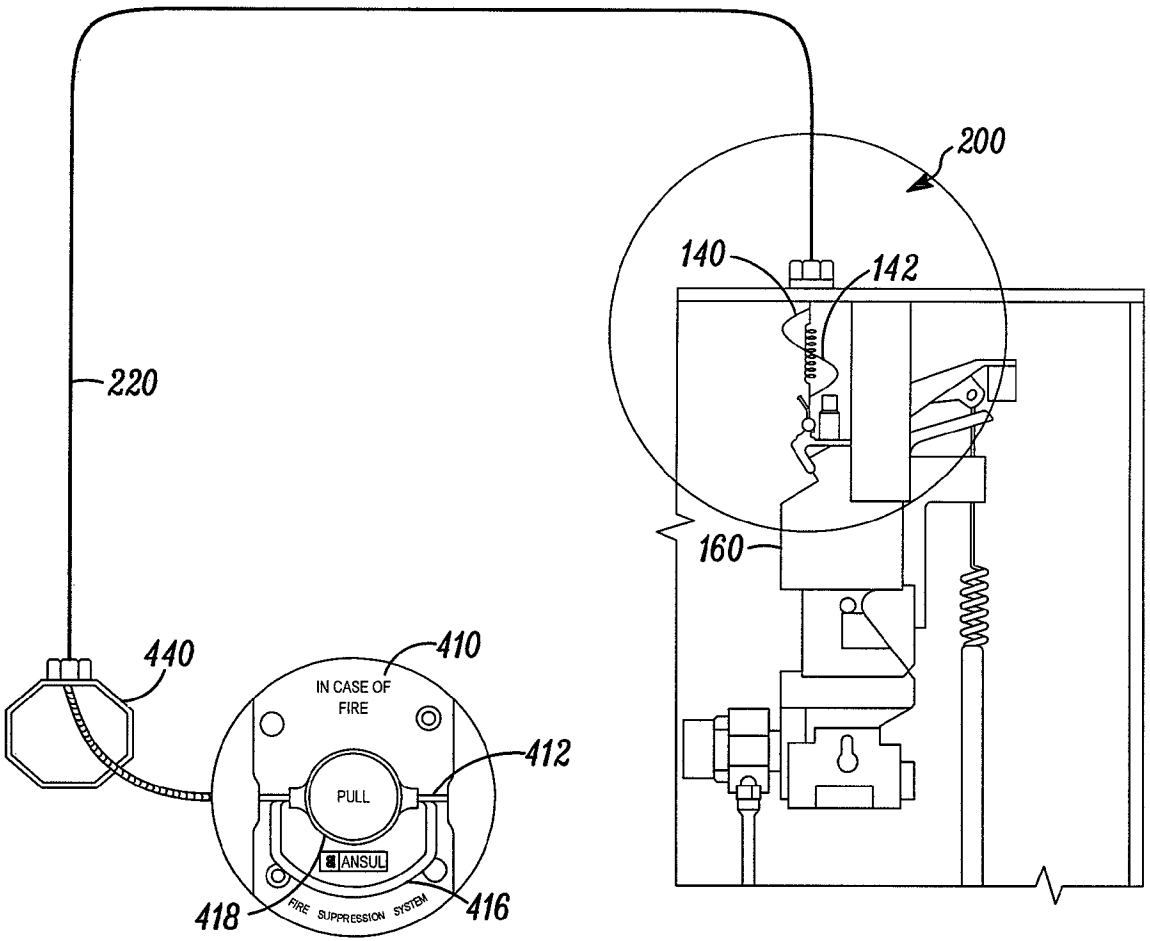
FIG. 14 is a representation of the pull station, flexible cable routing, and auto wire rope tensioning mechanism.

The equation $F_1=F_2e^{usk\bar{B}}$ may be used to describe the characteristics of the flexible conduit system shown in FIGS. 6 and 14. $F_1$ may be the force at one end of the wire rope (such as where the wire rope 140 is connected to the pull station 400), and F2 may be the force at the other end of the rope (such as where the wire rope 140 is connected to the release mechanism 160 of the pressurizing control station 100 or 200). The coefficient of static or kinetic friction may be represented by usk. The angle B may be expressed in radians.

Figure 18A:
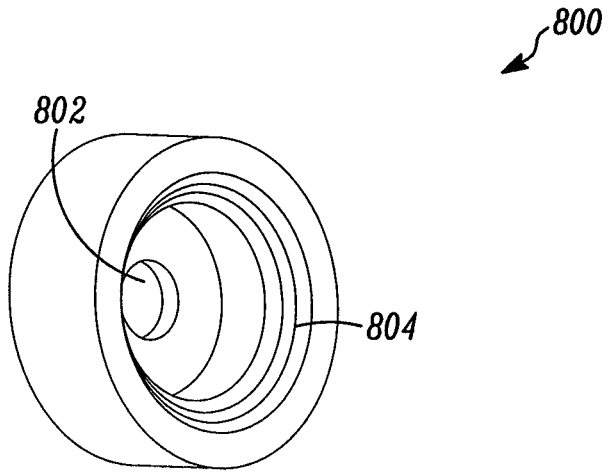
FIG. 18A depicts a perspective view of a PG9 cap.

As discussed above, there are a variety of ways by which the flexible conduit 220 (and the wire rope 140 inside the flexible conduit) may be attached to various structures in the fire suppression system. One example is depicted in FIGS. 18A-E. FIG. 18A depicts a perspective view of a PG9 cap 800. As discussed in more detail below, the PG9 cap 800 works in combination with compression fitting 810 and strain relief 820 to connect the flexible conduit 220 and the wire rope 140 to structures within the fire suppression system, such as junction boxes, valves, AUTOMAN® panel, etc.

The PG9 cap 800 includes a hole 802. As discussed in more detail below, the hole 802 may have a radius large enough to pass wire rope 140 through and a radius small enough so that the flexible conduit 220 cannot pass through. For example, the hole 802 may be sufficiently small so that the liner of the flexible conduit 220 (such as polyethylene liner 504 and acetal liner 320) cannot pass through. A further example may be where the hole 802 diameter is equivalent to the outer jacket diameter of the flexible conduit 502 and 310 to create an effective flexible conduit guide into the junction boxes 440 or 445 (as viewed in FIGS. 7B and 7D). Further, the PG9 cap 800 has an interior surface that includes threading 804. As discussed in more detail below, a portion of the strain relief 820 may connect to the threading 804.

Figure 18B:
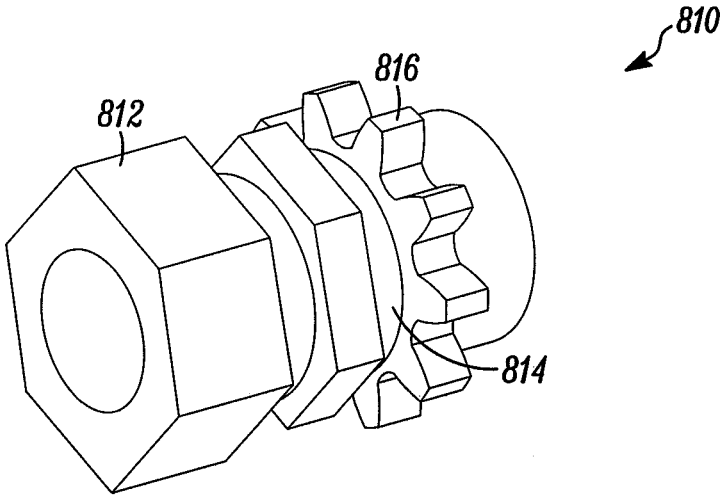
FIG. 18B depicts a perspective view of the compression fitting.

FIG. 18B depicts a perspective view of the compression fitting 810. The compression fitting 810 includes compression fitting cap 812 and compression fitting main body 814. The compression fitting main body 814 may be connected to a structure within the fire suppression system, such as junction box 120, using bolt 816.

Figure 18C:
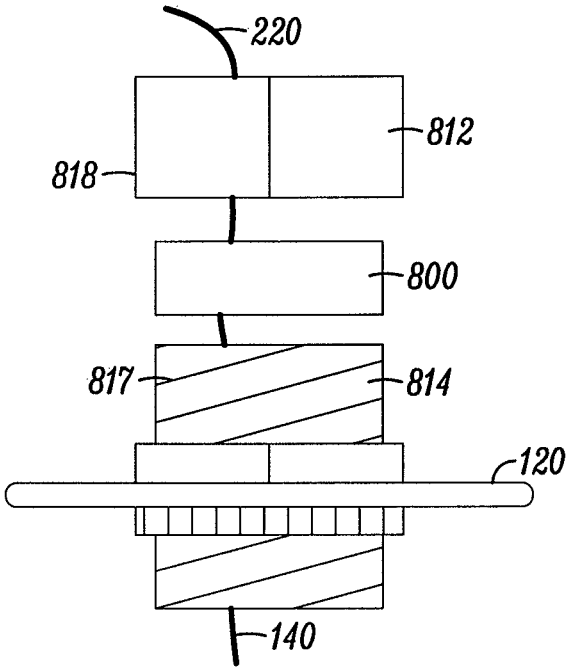
FIG. 18C depicts an exploded view of the compression fitting and the PG9 cap depicted in FIGS. 18A-B.

FIG. 18C depicts an exploded view of the compression fitting 810 and the PG9 cap 800. The PG9 cap 800 may be sandwiched in between the compression fitting cap 812 and the compression fitting main body 814. The compression fitting cap 812 may then be attached to the compression fitting main body 814, such as by screwing the compression fitting cap 812 onto the compression fitting main body 814 via threads 817 on the compression fitting main body 814 and threads on an interior surface of the compression fitting cap 812 (not shown). The outer diameter of the PG9 cap 800 may be less than the inner diameter of the compression fitting cap 812 so that the compression fitting cap 812 may slide onto the PG9 cap 800. Further, the outer diameter of the PG9 cap 800 may be less than or equal to the outer diameter of the compression fitting main body 814. In this way, when the compression fitting cap 812 is screwed onto the compression fitting main body 814, the PG9 cap 800 may be securely compressed in between.

Figure 18D:
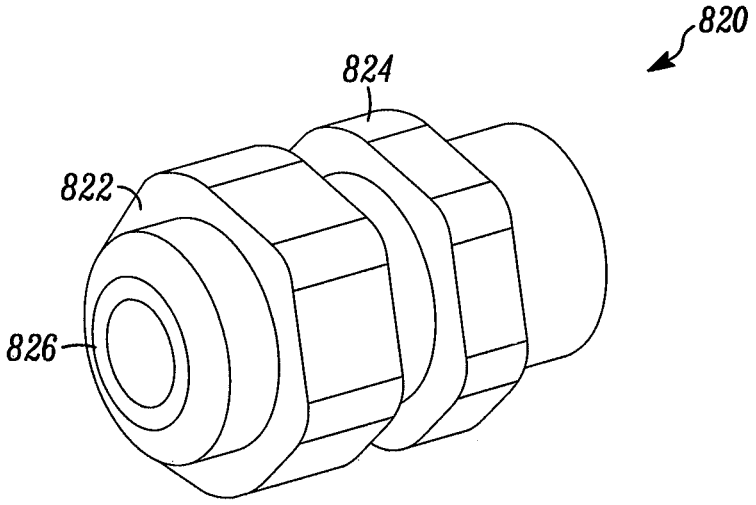
FIG. 18D depicts a perspective view of the strain relief.

FIG. 18D depicts a perspective view of the strain relief 820. The strain relief 820 includes strain relief cap 822 and strain relief main body 824. The strain relief cap 822 includes a hole 826 by which the flexible conduit 220 may be attached. The strain relief main body 824 includes threading 828 for threading with the threads 804 of the PG9 cap 800. In this way, the strain relief 820 may be attached.

Figure 18E:
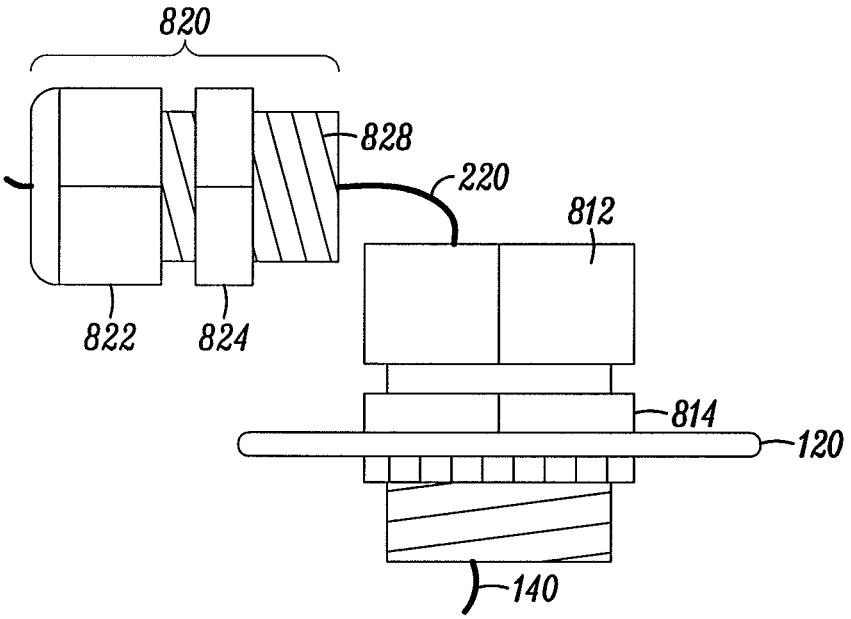
FIG. 18E depicts a side view of the strain relief and the compression fitting prior to attachment of the strain relief.

FIG. 18E depicts a side view of the strain relief 820 and the compression fitting 810 prior to attachment of the strain relief 820. As shown, the flexible conduit may be attached to the strain relief 820. And, using PG9 cap 800, the wire rope 140 may be guided into the junction box 120.

Considering Teflon® to steel usk=0.04 (such as where the liner 320 is composed of Teflon® and the wire rope 140 is composed of steel), $F_2$=6 lbs and $F_1$=40 lbs, then B=47.4 radians or 2717 degrees. Without a liner and/or lubricant, the coefficient of friction is higher, such as usk=0.15. Using the same forces of $F_2$=6 lbs and $F_1$=40 lbs, the B=12.6 radians or 724 degrees. Comparing these two examples illustrate the significant impact that a lower coefficient of friction has on the flexible conduit constraints. In the example using usk=0.04, the flexible conduit may be bent 30 times at right angles whereas the example using usk=0.15 (without the liner), the flexible conduit may be bent at the same angle only 8 times.

Figure 1:
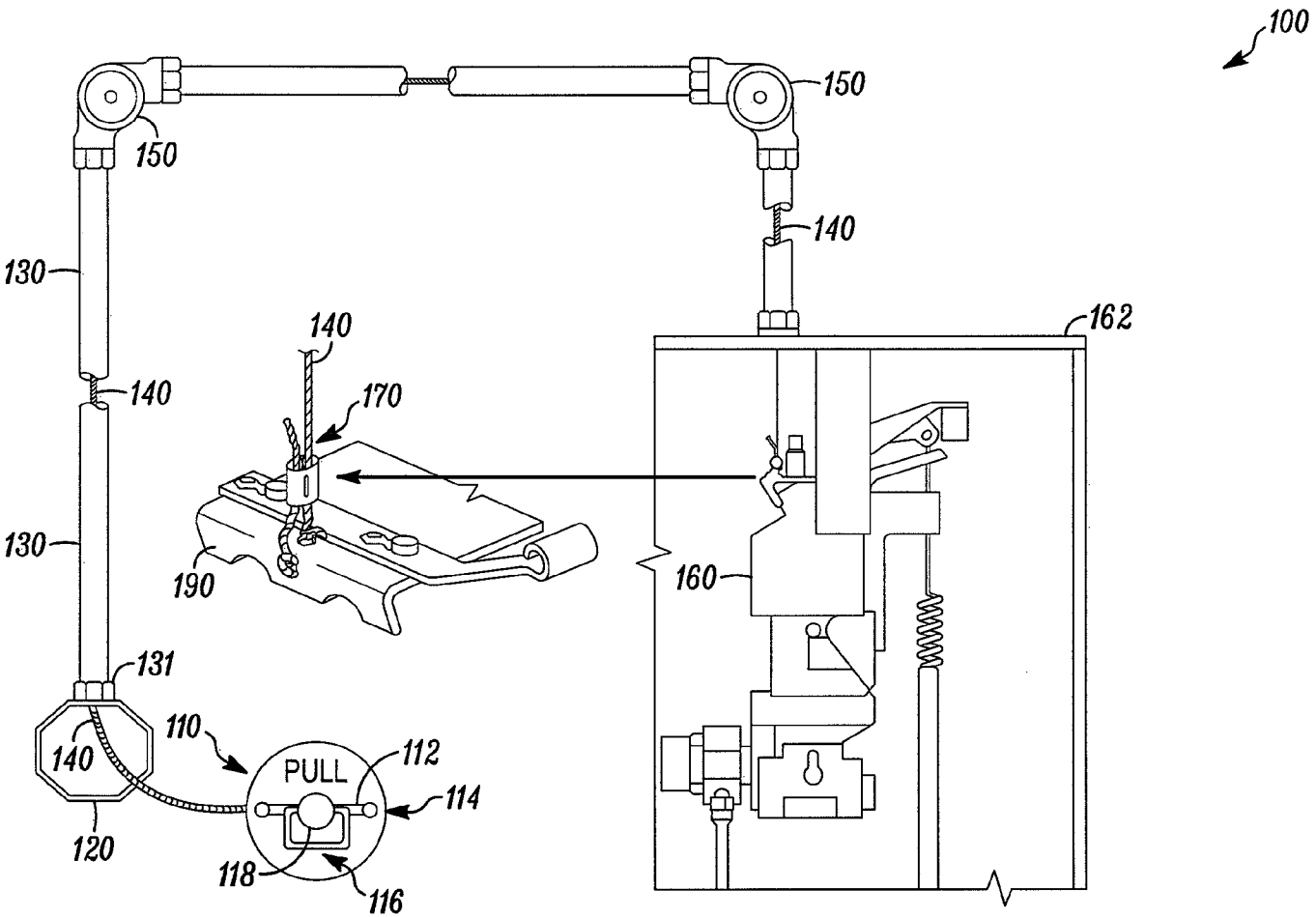
(PRIOR ART) FIG. 1
FIG. 1 is a representation of a prior art fire suppression system using rigid conduit routing.
Figure 2:
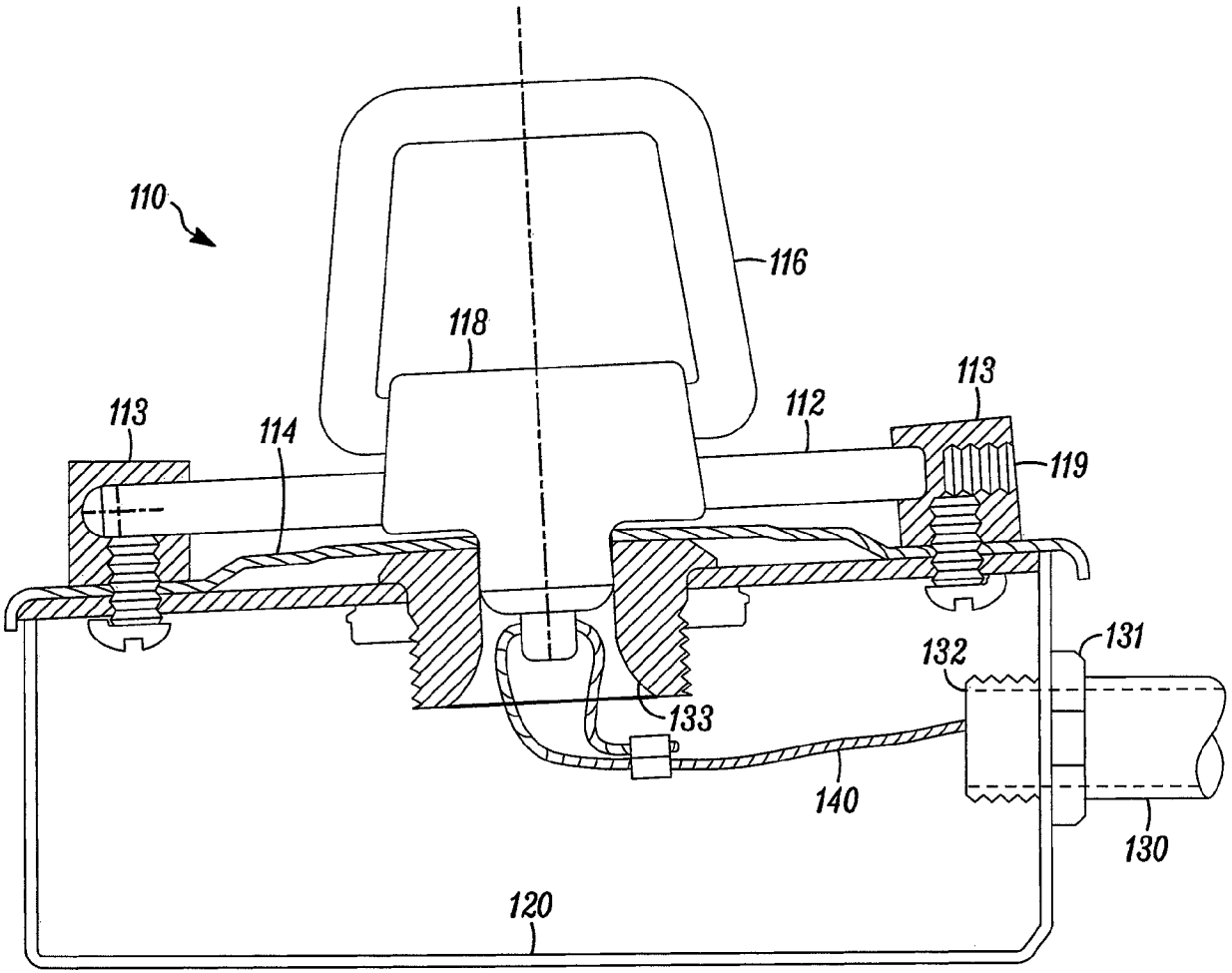
(PRIOR ART) FIG. 2
FIG. 2 is a cross-section of a prior art pull handle with wire rope connection.
Figure 3:
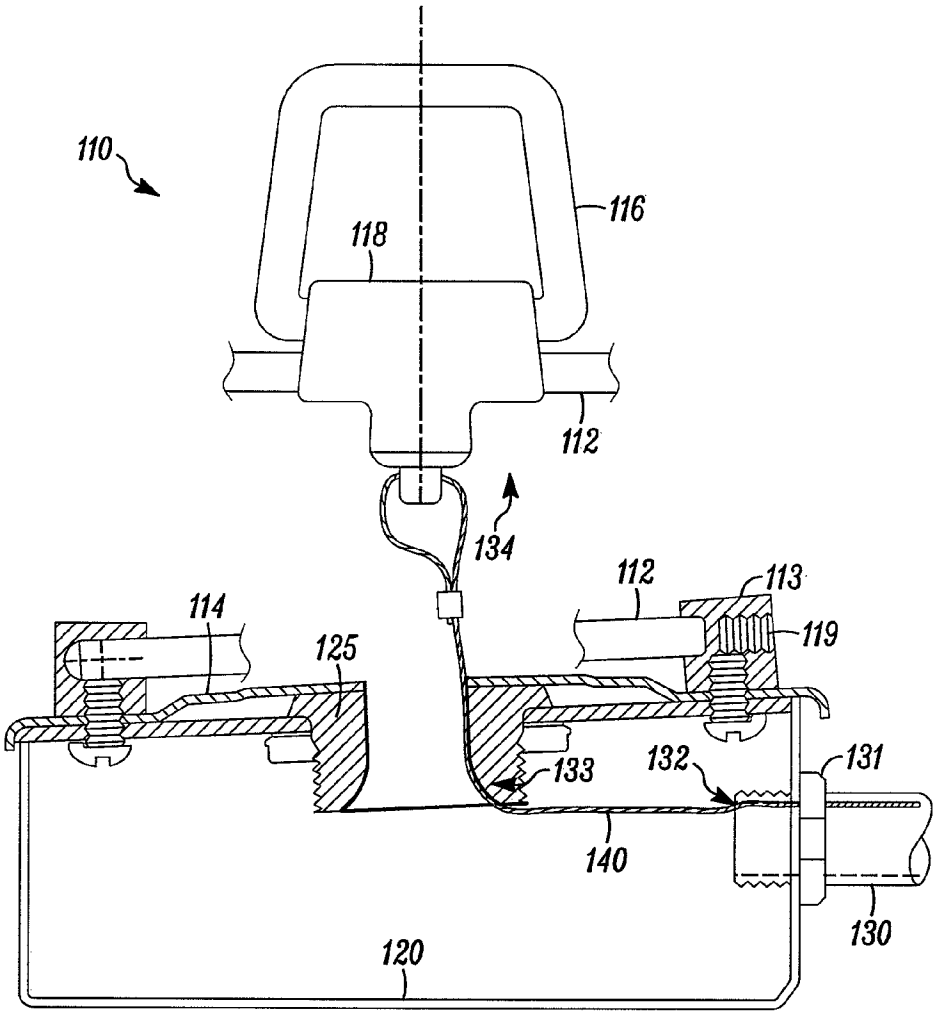
(PRIOR ART) FIG. 3
FIG. 3 is a cross-section of a prior art pull handle with wire rope connection that has been activated.
Figure 4A:
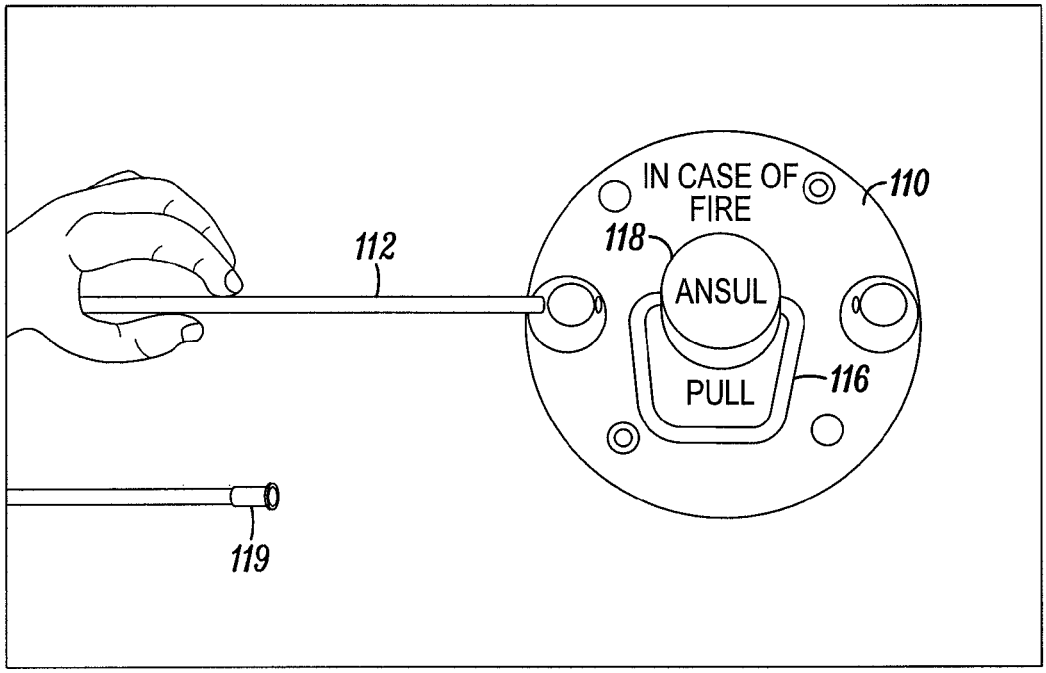
FIGS. 4A-C illustrate a prior art sequence for installing a break rod.
Figure 4B:
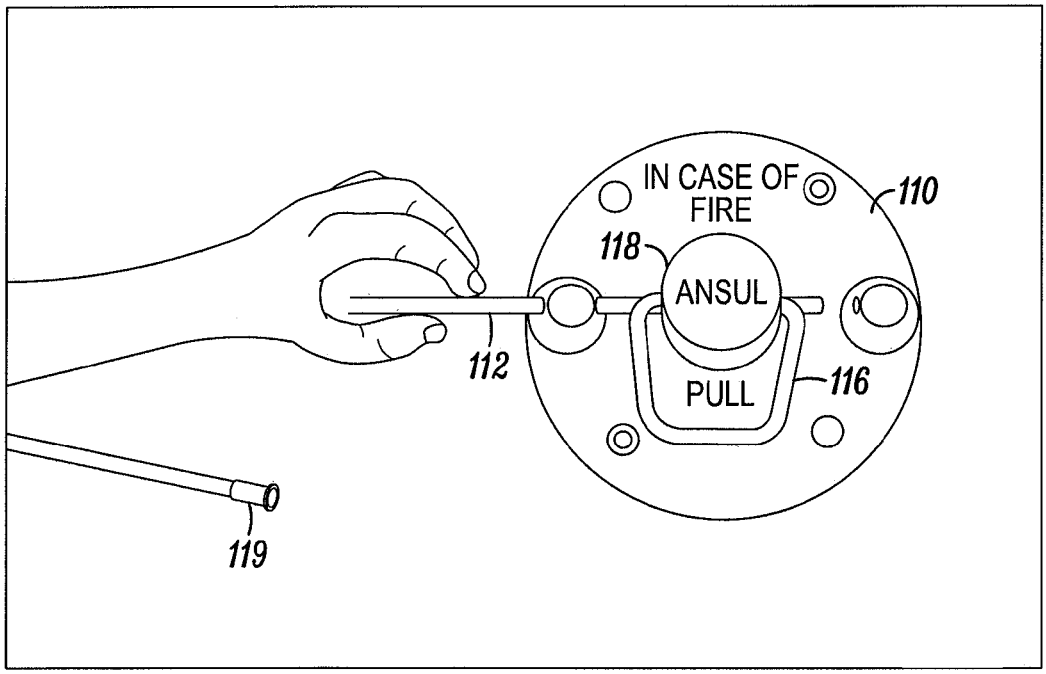
Figure 4C:
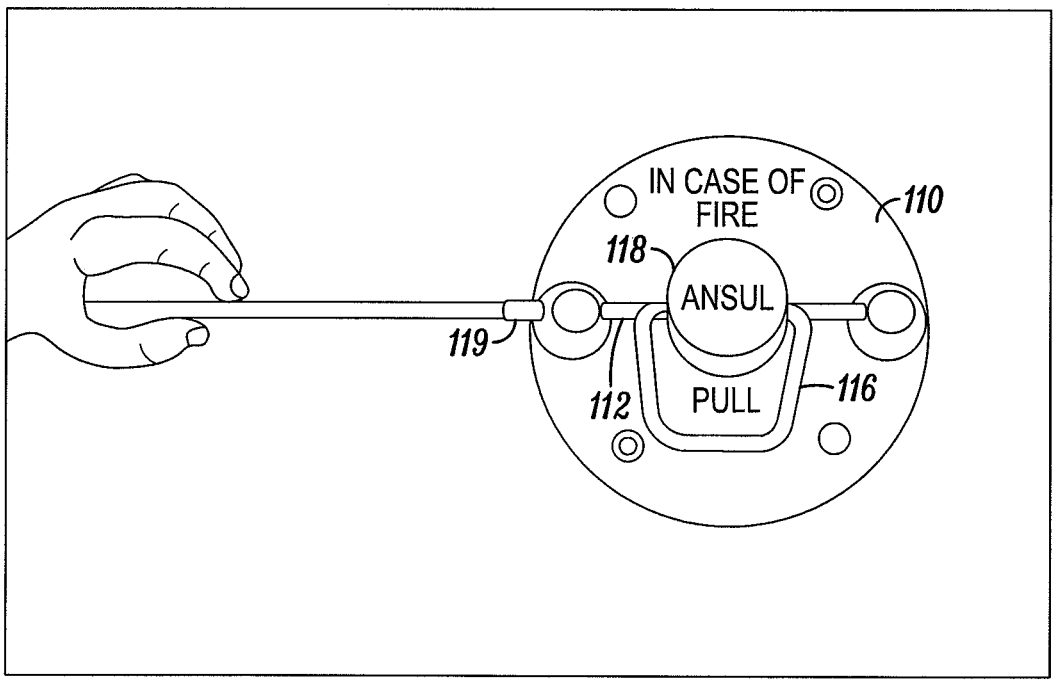

The flexible conduit 220 in the fire suppression system may be easier to install than the EMT 130 and the 90 degree pulley elbows 150 shown in FIG. 1. Further, the flexible conduit 220 still provides a reliable system similar to the fire suppression system shown in FIG. 1. The flexible conduit system was cycled more than 8,000 times without signs of degradation. The system passed a 500 cycle test with 150 feet of lined and coated Bowden conduit, eight 90 degree bends with a 3" radius, 15 pulley elbows, a pull station with a built-in pulley block, and a 6 lb load at one end, the resulting force on the other end being 37.23 lbs on average with a standard deviation of 1.45 lbs. With a similar setup, except with a pull station having an ultrahigh molecular weight polyethylene (UHMW) busing and a three pound load, the resulting force was 30.83 pounds with a standard deviation of 1.25 lbs.

As discussed above, the flexible conduit may be connected to the Ansul AUTOMAN® panel, gas valve, corner pulleys, electrical box, EMT conduit, etc. For example, the flexible conduit may be connected between the Ansul AUTOMAN® panel and the pull station, up to 140 ft and four 90° bends. When the flexible conduit is used to make 90° bends, these bends may start from the AUTOMAN® panel or gas valve, with some or no mechanical 90° elbows being used in between these bends. If more than four 90° bends are used, then mechanical pulleys may be used. The flexible conduit may also be connected between the Ansul AUTOMAN® panel and the gas valve, up to 75 ft and four 90° bends and four corner pulleys. The flexible conduit may be placed along the same path as the EMT conduit would normally be run. Stainless steel rope may be routed through the flexible conduit. The flexible conduit may be distanced from hood or other high temperature items by more than 6 inches. These examples are provided for illustration purposes only.

Alternatively, instead of using wire rope 140 to connect the pull handle 416 to the release mechanism 160, other means may be used. For example, activation of the pull handle 416 may in turn activate a circuit (such as a switch) which could send a signal to a releasing mechanism. The signal may be an electrical signal transmitted via an electrical wire. Or, the signal may be a wireless signal, which may be transmitted via a transceiver and received at the release mechanism (such as the Ansul AUTOMAN® panel, which may include a wireless receiver and/or transmitter).

Moreover, instead of using wire rope 140, a fiber optic cable may be used. For example, the pull station may be connected between a first fiber optic cable and a second fiber optic cable. Specifically, a light source may be connected to the first fiber optic cable, sending a beam through the first fiber optic cable. A panel may be connected to the second fiber optic cable. In the event that the pull station is not activated, light traveling through the first fiber optic cable may be interrupted, indicating to the panel that the pull station has not been activated. In the event that the pull station is activated (such as by pulling the pull handle 416), light traveling through the first fiber optic cable may not be interrupted, indicating to the panel that the pull station has been activated.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A pull station comprising:

a pull handle configured to connect to a rope, the rope further connected to a release mechanism for a fire suppression system;

a junction box comprising a first opening and a second opening;

a pulley;

a pulley block, the pulley in fixed relation to and mounted with the pulley block; and a faceplate;

wherein the pulley changes a direction of the rope;

wherein the faceplate, the pulley block, and the pulley are configured to be positioned relative to one another in a first configuration and a second configuration, wherein, in the first configuration and the second configuration, each of the faceplate, the pulley block and the pulley are connected to the pull station, wherein, in the first configuration, the rope exits the junction box along a centerline of the first opening, wherein, in the second configuration, the rope exits the junction box along a centerline of the second opening, and wherein the pulley is configured to reduce an amount of force necessary to pull the pull handle in order to activate the release mechanism.

2. The pull station of claim 1, wherein a groove on the pulley block is pressed into the faceplate to engage the faceplate.

3. The pull station of claim 1, wherein the pulley block is connectable with the faceplate in at least two ways depending on a size of the junction box.

4. The pull station of claim 3, wherein a first way of the pulley comprises a shallow box configuration for a shallow box; and wherein a second way of the pulley comprises a deep box configuration for a deep box.

5. The pull station of claim 1, wherein the pulley block is connectable with the faceplate in the first configuration and the second configuration.

6. The pull station of claim 1, further comprising a flexible conduit, the rope disposed to slide axially within the flexible conduit, wherein a material is on at least one of the rope or an interior of the flexible conduit in order to reduce a coefficient of friction.

7. The pull station of claim 6, wherein the flexible conduit comprises a plastic liner; and wherein a lubricant is applied on at least one of an interior of the plastic liner or the rope.

8. The pull station of claim 1, wherein the pulley is proximate to the pull lever.

9. A pull station comprising:

a junction box;

a pulley;

a pull handle assembly, the pull handle assembly comprising a pull handle configured to connect to a rope, the rope further connected to a release mechanism for a fire suppression system; and a faceplate;

wherein the pull station includes at least one structure for installation of the pulley in the junction box in a plurality of orientations, each of the plurality of orientations resulting in the rope exiting the pull station in a different direction;

wherein the pull handle assembly is configured to interface with a break rod, wherein at least one of at least a part of the pull handle assembly that is configured to interface with the break rod or the faceplate is configured to move in order to install the break rod, the movement of the pull handle assembly to install the break rod being in a direction different from movement of the pull handle assembly to activate of the pull station.

10. The pull station of claim 9, wherein the faceplate is stationary and the at least a part of the pull handle assembly that is configured to interface with the break rod is rotatable.

11. A method for configuring a pull station comprising a pull handle assembly and a faceplate, the pull handle assembly adapted to interface with a break rod, the method comprising:

moving at least one or both of at least a part of the pull handle assembly that is configured to interface with the break rod or the faceplate in order to install the break rod, the movement to install the break rod being in a direction different from movement of the pull handle assembly to activate the pull station, wherein moving the pull handle assembly or the faceplate to install the break rod is an axial movement relative to the movement of the pull handle assembly to activate the pull station; or wherein moving the pull handle assembly or the faceplate to activate the pull station is perpendicular to a plane defined by the movement of the pull handle assembly to install the break rod.

12. The method of claim 11, wherein said moving comprises rotating the at least a part of the pull handle assembly that is configured to interface with the break rod and the faceplate relative to one another, the direction of rotation being different from the movement of the pull handle assembly to activate the pull station.

13. The method of claim 12, wherein the faceplate is stationary and the at least a part of the pull handle assembly that is configured to interface with the break rod is rotated.

14. The method of claim 12, wherein the faceplate is rotated and the at least a part of the pull handle assembly that is configured to interface with the break rod is stationary.

15. The method of claim 12, wherein said rotating comprises:

rotating the at least one of at least a part of the pull handle assembly that is configured to interface with the break rod or the faceplate in a first direction;

inserting the break rod; and rotating the at least one of at least a part of the pull handle assembly that is configured to interface with the break rod or the faceplate in a second direction, the second direction being opposite to the first direction.

16. The method of claim 15, wherein said rotating in the first direction comprises rotating only one of the part of the pull handle assembly that is configured to interface with the break rod or the faceplate in the first direction.

17. The method of claim 11, wherein moving the pull handle assembly to install the break rod comprises a rotational movement, the pull handle assembly during the rotational movement being at a same distance from a plane defined by the faceplate.

18. A method for configuring a pull station comprising a pull handle assembly and a faceplate, the pull handle assembly adapted to interface with a break rod, the method comprising:

prior to moving at least one of at least a part of the pull handle assembly that is configured to interface with the break rod or the faceplate, unlocking at least a portion of the pull handle assembly with at least a portion of the faceplate or unlocking at least a portion of the faceplate with at least a portion of the pull handle assembly; and moving at least one or both of at least a part of the pull handle assembly that is configured to interface with the break rod or the faceplate in order to install the break rod, the axial movement of the pull handle assembly to install the break rod being in a direction different from movement of the pull handle assembly to activate the pull station, wherein moving comprises at least one of:

axially moving the at least one or both of the at least a part of the pull handle assembly or the faceplate; or moving of the at least a part of the pull handle assembly perpendicular to a plane defined by movement of the pull handle assembly to activate the pull station.

19. The method of claim 18, wherein said unlocking includes unlocking the at least a portion of the pull handle assembly with the at least a portion of the faceplate.

20. The method of claim 19, further comprising:

after installing the break rod, locking the at least a portion of the pull handle assembly with the at least a portion of the faceplate.

* * * * *